US008905384B2

(12) United States Patent
Rodrigs et al.

(10) Patent No.: US 8,905,384 B2
(45) Date of Patent: Dec. 9, 2014

(54) ROOM VENT HUMIDIFIER

(75) Inventors: Jeri Rodrigs, Ottawa (CA); James Henderson, Kanata (CA); Kevin J. Bailey, Ottawa (CA)

(73) Assignee: Jeri Rodrigs, Ottawa, Ontario ( * ) Notice: Subject to any disclaimer, the term of this patent is extended or adjusted under 35 U.S.C. 154(b) by 325 days.

(21) Appl. No.: 13/424,647

(22) Filed: Mar. 20, 2012

(65) Prior Publication Data

US 2012/0267804 A1 Oct. 25, 2012

Related U.S. Application Data

(60) Provisional application No. 61/478,546, filed on Apr. 24, 2011.

(30) Foreign Application Priority Data

Apr. 26, 2011 (CA) ..... 2738326

(51) Int. Cl.
*B01F 3/04* (2006.01)
*F24F 6/04* (2006.01)
*F24F 6/00* (2006.01)

(52) U.S. Cl.
CPC ..... *F24F 6/04* (2013.01); *F24F 2006/008* (2013.01)
USPC ..... 261/34.1; 261/99; 261/107; 261/119.1

(58) Field of Classification Search
USPC ..... 261/99, 107, 119.1, 39.1
See application file for complete search history.

(56) References Cited

U.S. PATENT DOCUMENTS

| | | | | |
|---|---|---|---|---|
| 2,137,905 | A | 11/1938 | Church et al. | |
| 2,273,587 | A * | 2/1942 | Myers | 454/328 |
| 2,276,135 | A | 3/1942 | Woolley | |
| 3,171,401 | A | 3/1965 | McDuffee | |
| 3,290,020 | A | 12/1966 | Findley | |
| 3,307,835 | A | 3/1967 | Perlman | |
| 3,315,948 | A | 4/1967 | Martin | |
| 3,427,005 | A | 2/1969 | Kuykendall | |
| 3,640,265 | A | 2/1972 | Swart, Sr. | |
| 3,834,683 | A | 9/1974 | McDuffee | |
| 4,029,723 | A | 6/1977 | Morrison et al. | |
| 4,056,049 | A | 11/1977 | Stuckey | |

(Continued)

FOREIGN PATENT DOCUMENTS

JP 05113236 A * 5/1993 ..... 261/119.1

*Primary Examiner* — Robert A Hopkins
(74) *Attorney, Agent, or Firm* — Ridout & Maybee LLP

(57) ABSTRACT

A room humidifying apparatus is provided which operates with minimum cost and without any electrical power. The humidifier is located so as to make use of a stream of air coming from a register. The humidifier has a casing carrying a main water tank, a water pan and an evaporative filter element which are located in the casing. The tank drips water onto the filter element, which has a lower portion located in the water pan to collect any excess water dripping down the filter element and also to moisten it with capillary effect. Heated air from the register becomes humidified on passing through the filter element. The water tank can be filled manually from the top or be detachable and filled through a bottom refill opening. Alternatively, the water tank can be connected to a water source with a valve to regulate the flow of water into the water tank. The water tank may be balanced so as to displace, for example tilt, from a first position when it contains water to a second position when it is empty.

40 Claims, 17 Drawing Sheets

(56) References Cited

U.S. PATENT DOCUMENTS

| | | | |
|---|---|---|---|
| 4,226,174 | A | 10/1980 | Vesper |
| 4,231,975 | A | 11/1980 | Peltier |
| 4,240,991 | A | 12/1980 | Shaub |
| 4,307,656 | A | 12/1981 | Vesper |
| 4,327,630 | A | 5/1982 | Brassine |
| 4,338,859 | A | 7/1982 | Claytor |
| D265,852 | S | 8/1982 | Vesper |
| 4,706,552 | A | 11/1987 | Maguire |
| 5,037,586 | A | 8/1991 | Mehrholz et al. |
| 5,061,405 | A | 10/1991 | Stanek et al. |
| 5,133,044 | A | 7/1992 | Chiu |
| 5,324,230 | A | 6/1994 | Hist |
| 5,403,233 | A | 4/1995 | Daneshvar |
| 5,682,932 | A | 11/1997 | Ediger |
| 5,783,117 | A | 7/1998 | Byassee et al. |
| 6,850,698 | B1 | 2/2005 | Goh |
| 7,828,275 | B2 | 11/2010 | Won |
| 2002/0195728 | A1 | 12/2002 | Wooderson |

* cited by examiner

SECTION B-B

ROOM VENT HUMIDIFIER

CROSS-REFERENCE TO RELATED APPLICATIONS

This application is related to and claims priority from U.S. Provisional patent application No. 61/478,546 filed Apr. 24, 2011 and Canadian patent application No. 2,738,326 filed Apr. 26, 2011, the entire contents of each of which are incorporated herein by reference.

TECHNICAL FIELD

This invention relates to a type of room humidifier which does not need an external source of power (i.e. electricity), and which can operate at a low cost.

BACKGROUND ART

Interior air can become very dry in the countries like Canada, Europe and Northern US during the winter months where forced air furnace heating systems are provided in many homes. The interior relative humidity level can drop to as low as 15% if the house is not equipped with a humidifier. Electrically powered furnace humidifiers are available but they are not entirely effective in bringing the humidity level to a comfortable level because furnace humidifiers are installed close to the heat source which makes them ineffective especially in a multiple story building; by the time heated air reaches the farthest level of the building the moisture level is reduced. A central humidifier cannot solve the problem in its entirety. A room humidifier can raise the relative humidity level of a room up to 50% by working locally.

Most modern day room humidifiers now on the market are electrically powered and must be plugged into a wall socket to operate, so there is cost involved in operating them. These electrically powered humidifiers have electrical motors therein which may emit an unpleasant noise. Because they contain complicated electrical devices inside, they are prone to breakdowns.

Room humidifiers that do not require electricity to operate are known, for example from the patents listed below. However, these humidifiers are usually designed to be used with one type of heating system (often radiators) and are not very versatile. Many of these prior art humidifiers tend to be cumbersome since they are bulky and take up a lot of space on the floor and may interfere with normal human activity in the room. They may also not be compatible for fixing onto the modern day forced air furnace vents. Also, because the water container in them is usually placed between the heat source and the absorbent material, these humidifiers are not very effective or efficient. Previously-known such humidifiers, including the ones mentioned below, may have one or more of the following drawbacks: A) their main water tanks are not detachable from the casings and portability of main water tank for refills becomes an issue; this makes refilling of the tank difficult and not practical for commercial market applications; and B) they have small tank capacity and need frequent refills; C) They are not a modular in design for easy manufacture or easily attachable to vents; D) The evaporative element is not stand alone and usually sits directly in the main water tank and evaporates directly from the main water tank, making it inefficient and difficult to maintain.

The following U.S. patents (and application) are representative of the prior art:

Appln. No 2002/0195728 published December, 2002, to Wooderson;
U.S. Pat. No. 7,828,275 issued November, 2010 to Won;
U.S. Pat. No. 6,850,698 issued February 2005 to Goh;
U.S. Pat. No. 5,403,233, issued April 1995 to Daneshvar;
U.S. Pat. No. 5,324,230 issued June 1994 to Hist;
U.S. Pat. No. 5,093,895 issued March 1992 to Ghorayeb;
U.S. Pat. No. 4,706,552 issued November 1987 to Maguire;
U.S. Pat. No. 4,338,859 issued July 1982 to Claytor;
U.S. Pat. No. 4,327,630 issued May 1982 to Brassine;
U.S. Pat. No. 4,307,656 issued December 1981 to Vesper;
U.S. Pat. No. 4,240,991 issued December 1980 to Shaub;
U.S. Pat. No. 4,226,174 issued October 1980 to Vesper;
U.S. Pat. No. 4,056,049 issued November 1977 to Stuckey;
U.S. Pat. No. 4,006,674, issued February to Culver, and
U.S. Pat. No. 27,461, issued March 1860 to McNeill.

The application of Wooderson, and the U.S. Pat. Nos. 4,706,552 to Maguire and 4,338,859 to Claytor, show devices which are largely or completely contained within the upper part of a floor register, and where the water tank is below floor level. This means that the water tank is small, and may be awkward to fill.

The humidifier disclosed in U.S. Pat. No. 7,828,275 to Won has the following drawbacks: a plurality of evaporating filters makes the humidifier costly to manufacture and also hard to maintain and also makes it costly to replace the evaporating elements. The many evaporating filters also make the evaporation rate high, relative to the reservoir size, which would require frequent re-fillings of the water tank.

The humidifier disclosed in U.S. Pat. No. 6,850,698 to Goh is a humidifier which has a main reservoir for holding water and for receiving an end of a paper towel while the other end is received by a rod located above and to the side of the reservoir, so that water wicks up the paper-towel through capillary migration and hot air passes over the moist towel. A paper towel is not an efficient and a rigid evaporating medium to humidify and to withstand the rough usage experienced in typical households. In this application the paper towel is partly exposed which makes it liable to damage, so this would need frequent replacement. The humidifier can only be used with a floor register and cannot be used with a wall register or vent. The apparatus is simply placed on the floor and is not positively located on the floor.

The humidifier described in U.S. Pat. No. 5,403,233 to Daneshvar is a rather fragile looking device used partly for decoration; the water trough is shallow and could not be expected to transmit much moisture to the evaporating elements.

The humidifier disclosed in U.S. Pat. No. 5,324,230 to Hist is a humidifier with an evaporating element which is exposed openly and not inside the casing, making it fragile. The main water tank is of low capacity and needs frequent refills for normal operation. The water tank is also open and exposed to the room and may be hazardous to kids and pets. It has a complicated installation mechanism for attachment to a wall. It can only be used with a wall register, and not with a floor register or vent.

The humidifier disclosed in U.S. Pat. No. 5,093,895 to Ghorayeb is designed for use with baseboard heaters, not for forced-air heating systems. It also has the problem that the main water tank does not detach from the casing and so is not portable for refills. This makes refilling the tank difficult and not practical for commercial market applications.

The humidifier disclosed in U.S. Pat. No. 4,327,630 to Brassine is too complicated, and has too many intricate fittings, to provide a marketable product. It uses a complicated evaporative member, and the construction involves many screws. It can only be used with floor register, and not with a wall register or vent.

The humidifier disclosed in U.S. Pat. No. 4,240,991 to Shaub has a humidifier with a rotating propeller, which may not work well with the draft provided by a forced air furnace, and could create a blockage to air flow. Noise from the propeller is also a negative factor. This also can only be used with wall register, and cannot be used with a floor register or vent. Its water tank is of low capacity and needs frequent refills.

The humidifier disclosed in U.S. Pats. Nos. 4,226,174 and 4,307,656 to Vesper have the following shortcomings: they can only be used with a wall register and cannot be deployed on residential floor vents connected to a forced air furnace. The insert material is bulky and can cause large mineral deposits from the water. The apparatus appears to be heavy and probably will not hang properly when the reservoir is filled with full capacity.

U.S. Pat. Nos. 4,056,049 to Stuckey and 4,006,674 to Culver both show types of apparatus intended to be used on floor registers, and having baffles which cause contact between the heated air and the top surface of a water tank. There is no filter element or like wicking element, so probably not much moisture is taken up by the air.

U.S. Pat. No. 27,461 to McNeill shows apparatus to be used with a wall register. The apparatus has parts which need to be fitted both above and below the register, which would make installation awkward.

Though the humidifiers of the type described above have been designed for humidifying heated air being forced into individual rooms, they seem to have met with minimal success in the commercial market due to lack of simplicity, lack of cost effectiveness, being hard to maintain, and not easy to install. Some have complex parts not designed to be mass produced at low cost, as is required for such apparatus to be employed in multiple rooms in a household.

Thus, it is apparent that there exists a need in cold countries for a non-electrically powered low cost humidifier which is easily compatible to be used with any types of modern day forced air heating systems (for example a natural gas furnace), which can be easily installed directly on the vents of rooms, is non-complex and easily maintainable, is simple in design and is also modular in allowing for different designs to be made with common components, environmentally friendly, highly efficient, easy to manufacture, light weight, compact and needing little space, is stable and rigid, and that such could be a success commercially.

This invention provides a new line of room vent humidifiers which fulfills at least some of these needs and potentially many other needs apparent to the skilled artisan in the relevant art.

SUMMARY OF THE INVENTION

This invention provides a room vent humidifier, for use with a warm air register of the type used for supplying warm air to a room, the humidifier being readily portable and arranged to operate without an electrical supply, and comprising:

a casing having an air inlet adapted to be positioned for receiving air from the register, and having an air outlet for directing the air from the casing, an air porous evaporative filter element in said casing positioned in the path of air when moving from said inlet to said outlet, and having an upper edge and a lower edge portion, an upper reservoir in the form of a main water tank at least partly located above the filter element and having water outlet means allowing water to drip from the tank onto the upper edge of the filter element, and a lower reservoir in the casing in the form of a lower water pan surrounding the lower edge portion of the filter element and arranged both for receiving water which drips from the filter element and for supplying water to the filter element by capillary action.

In this way the air porous evaporative filter element is moisturized by water on both the upper edge and on the lower edge portion. The water outlet means from the tank may be pin holes at the bottom of the main water tank.

The air porous evaporative filter element may be a single substantially vertical element made of highly absorbent wood pulp fiber which is positioned transversely to the air flow direction when the air moves from the inlet to the outlet.

Preferably the main water tank is easily removable for re-filling, and the filter element is mounted so as to be readily accessible and easily lifted from the casing for maintenance after removal of the main water tank. In this case the main water tank and the casing are provided with engaging means including a slide and detent mechanism. The removable tank may have a water refill opening at the bottom for filling the tank with water after it is detached from the casing, and the humidifier further may have a cap to close the opening to make the main water tank airtight.

Alternatively, the main water tank may have a water refill opening at the top for filling the water tank without removing it from said casing, and the humidifier may further comprise a cap to close the opening to make the main water tank airtight.

When the room humidifier is for use with a floor register, the casing may include deflecting means for redirecting vertically moving air from the floor register into a largely horizontal flow for movement through the filter element. Alternatively, where the humidifier is for use with a wall register, the casing may include a hollow channel for directing horizontally moving air from the wall register into a largely horizontal flow for movement through the filter element.

When designed for use with a floor register opening, the air inlet of the casing preferably has a flange which is adapted to extend into the register opening. Since modern day residential air vents usually are rectangular in shape, the basic design is suited to this standard rectangular shape. However, if need arises, the air inlet of this humidifier can be made in any shape and sizes to fit any room vent keeping the other portion of the casing standard. As an option, air-directing louvers can also be attached to the bottom of the casing so that the humidifier is adaptable to all types of heating system vents.

The water tank can be made of a plastic with glass water level indicator, can be made to contain various capacities, and, as indicated, may be detachable from the casing. In this case a water refill inlet hole along with its air-tight cap, and the pin hole openings for the water to drip and moisten the evaporative filter element, are on the bottom of the tank. Optionally, a refill inlet and a cap are provided on top of the tank as well to allow refilling of the water tank without detaching it from the casing. When the caps of the water tank are properly placed and tightened on the water tank, the water tank is airtight.

Another option is to equip the main water tank with a float valve assembly which is connected to a continuous water supply line, so that the valve assembly will regulate the intake of water into the main water tank without any manual intervention and refilling. For the precise control of the water through the pin hole opening from the water tank to the evaporative filter element, the humidifier can also be equipped with a temperature controlled valve or air controlled valve at the pin hole openings. Another option to optimize the water flow to the lower water pan is to have a spring operated valve at the bottom of the tank and to have this bottom of the tank seating in the water pan.

The evaporative filter element may be made of standard absorbent humidifier evaporative wick filter material with porous cell holes in a honey comb formation, and may stand vertically in the lower water pan, in the path of the air flow. The evaporative filter element may have a plastic frame for rigidity. It also may have a sheet metal mesh on the air outlet side to withstand the air flow without warping.

The purpose of the secondary lower water pan, which is of small capacity compared to the main water tank, is to collect the excess water dripping through the evaporative filter element. Another very important function of the water pan is to have the evaporative filter element constantly in contact with the water supply. The left-over water collected in the water pan will rise by capillary action along the absorbent material of the evaporative filter element keeping it continuously moisturised.

A protective grill may be installed at the air exit of the casing to protect the evaporative filter element from any external damage and to prevent any foreign debris entering the humidifier. The grill may have a slide shutter at the inside side of the grill which may be closed to control the air flow.

The pin hole openings at the bottom of the water tank and right above the evaporative filter element pass low amounts of water to moisten the evaporative filter element. The hot air from the heat source and the vent is directed through the main air passage corridor of the humidifier and passes through the moisture filled evaporative filter element which is at the hot air exit causing the air to become moist and humidify the surroundings.

The humidity level of the surroundings of this room vent humidifier is naturally and automatically controlled by the ON and OFF cycle of air flow from the heat source. The same on/off cycle keeps the water level in the lower water pan at a certain level and prevents it from overflowing. While the heat source is in the OFF mode, the evaporation rate from the filter element will be low. This will allow more water to drip into the lower water pan which will accumulate water. On the other hand, while the heat source is in the ON mode the evaporation rate of the filter element will be high, thus consuming all the water dripping from the main water tank and in the water pan. That ON mode high consumption of water from the water pan will keep the water level low and prevent over-flow.

Humidifiers embodying this invention can be employed with wall or floor vents of most forced air furnace heat sources now in the market.

Furthermore, to achieve the optimum result with this room vent humidifier, it is advisable to operate the heat source in the heating mode and the fan of the heating source in the auto or air circulation mode.

The main water tank, evaporative filter element, the grill and the lower water pan are easily detachable with a tab click type of detent mechanism making maintenance and cleaning of each component efficient. The click or detent assembly mechanism of all the modular parts without any screws is one of the main advantages of embodiments of this invention. Moreover, for seasons where humidification of the air is not required, the humidifier can simply be lifted from the vent and put into storage and replaced with a passive vent cover.

Preferred embodiments of the room vent humidifier invention will now be described by way of example only with reference to the accompanying drawings, as listed below.

DESCRIPTION OF PREFERRED EMBODIMENTS

Figure 1:
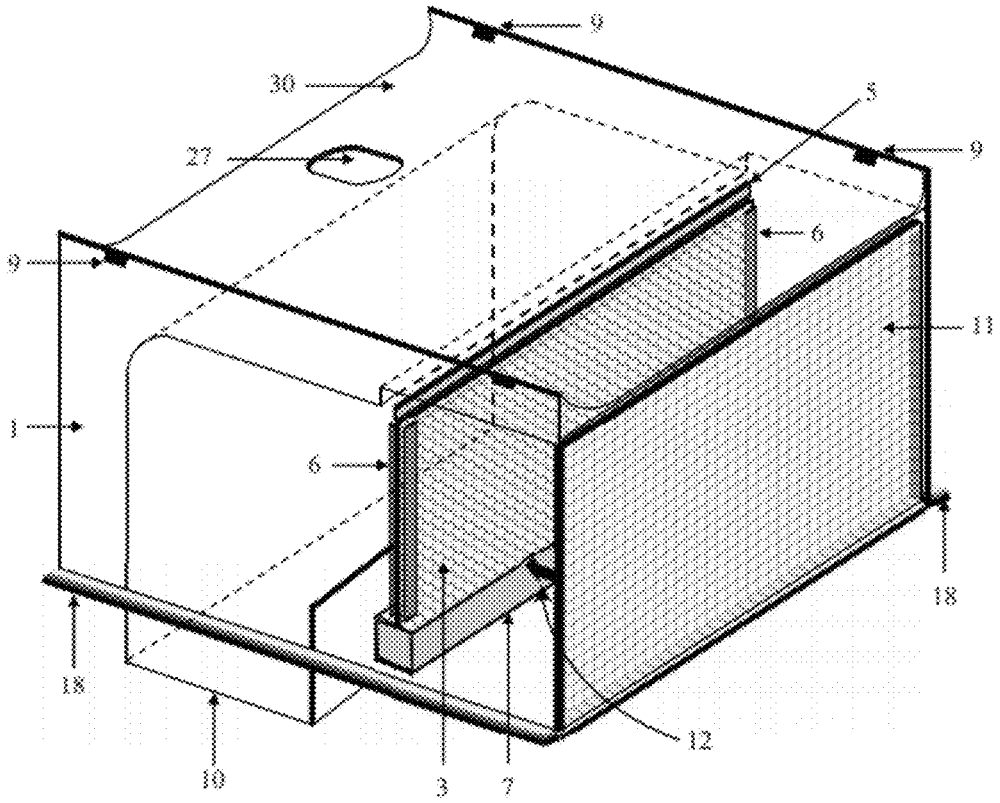
FIG. 1 is a sectionalized isometric inside view of a first preferred embodiment of this invention showing all the components except the water tank, which has been removed.

Referring to the accompanying drawings, various embodiments of this invention are described in detail below.

Preferred Embodiment 1 of this invention is illustrated in FIGS. 1-3 and 5-10. In this embodiment, the room humidifier is comprised mainly of casing (1), main water tank (2), evaporative filter element (3), lower water pan (7), and air outlet grill (11). Main water tank (2) and evaporative filter element (3) are located within casing (1) with evaporative filter element (3) being located underneath main water tank (2). Evaporative filter element (3) stands vertically inside the water pan (7) which surrounds a lower edge portion of the filter element. All of the components of this embodiment, including casing (1) and main water tank (2), can be made of plastic for the exception of evaporative filter element (3).

Casing (1) is the main body of the room vent humidifier on the top of which the main water tank (2) is situated. Casing (1) has projecting tabs on top providing water tank click tabs (9) for the main water tank (2) to slide and click in place.

Figure 2:
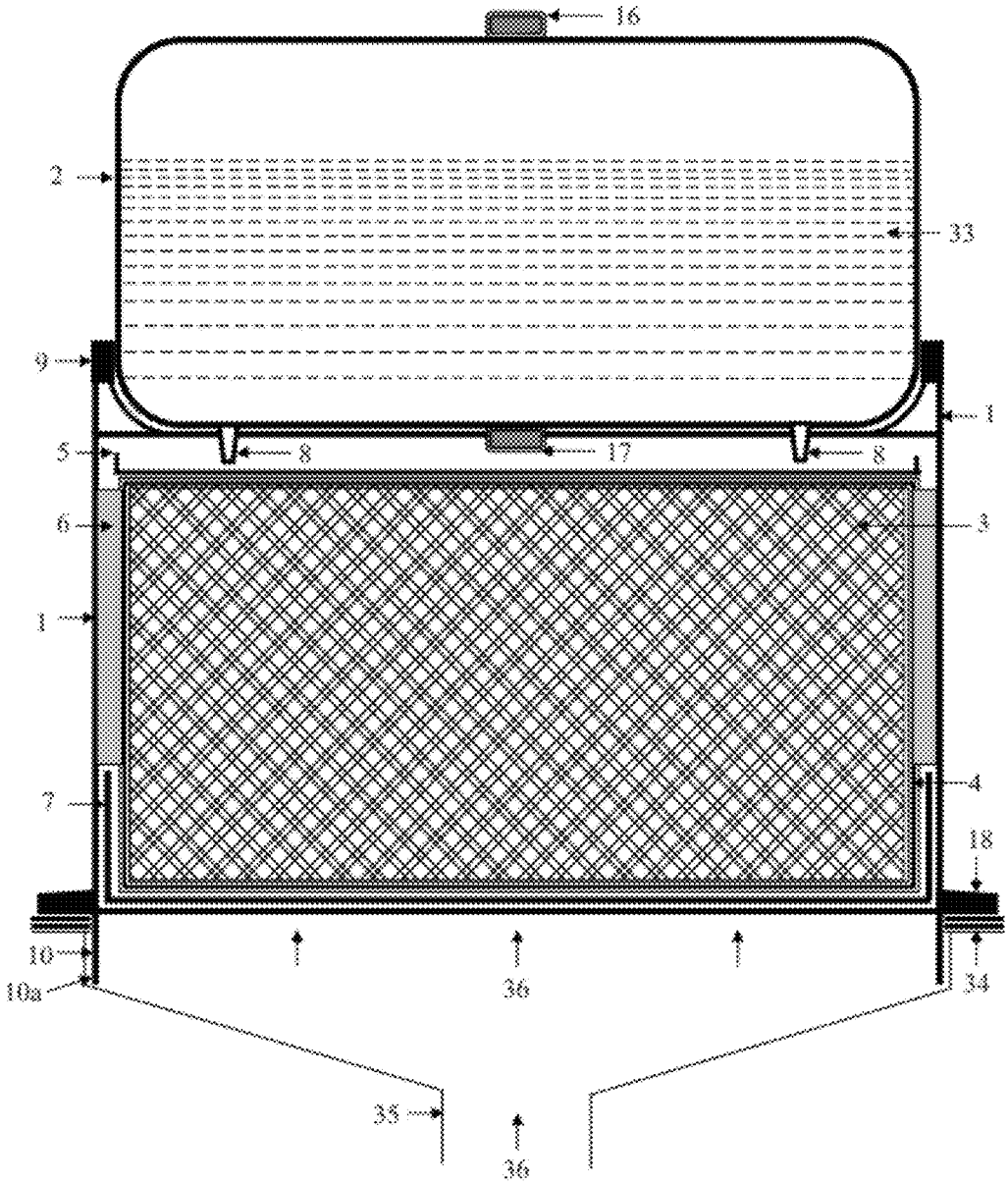
FIG. 2 is a sectionalized front elevation of the first preferred embodiment, sectionalized through the evaporative filter element, with sectional view of other components.
Figure 3:
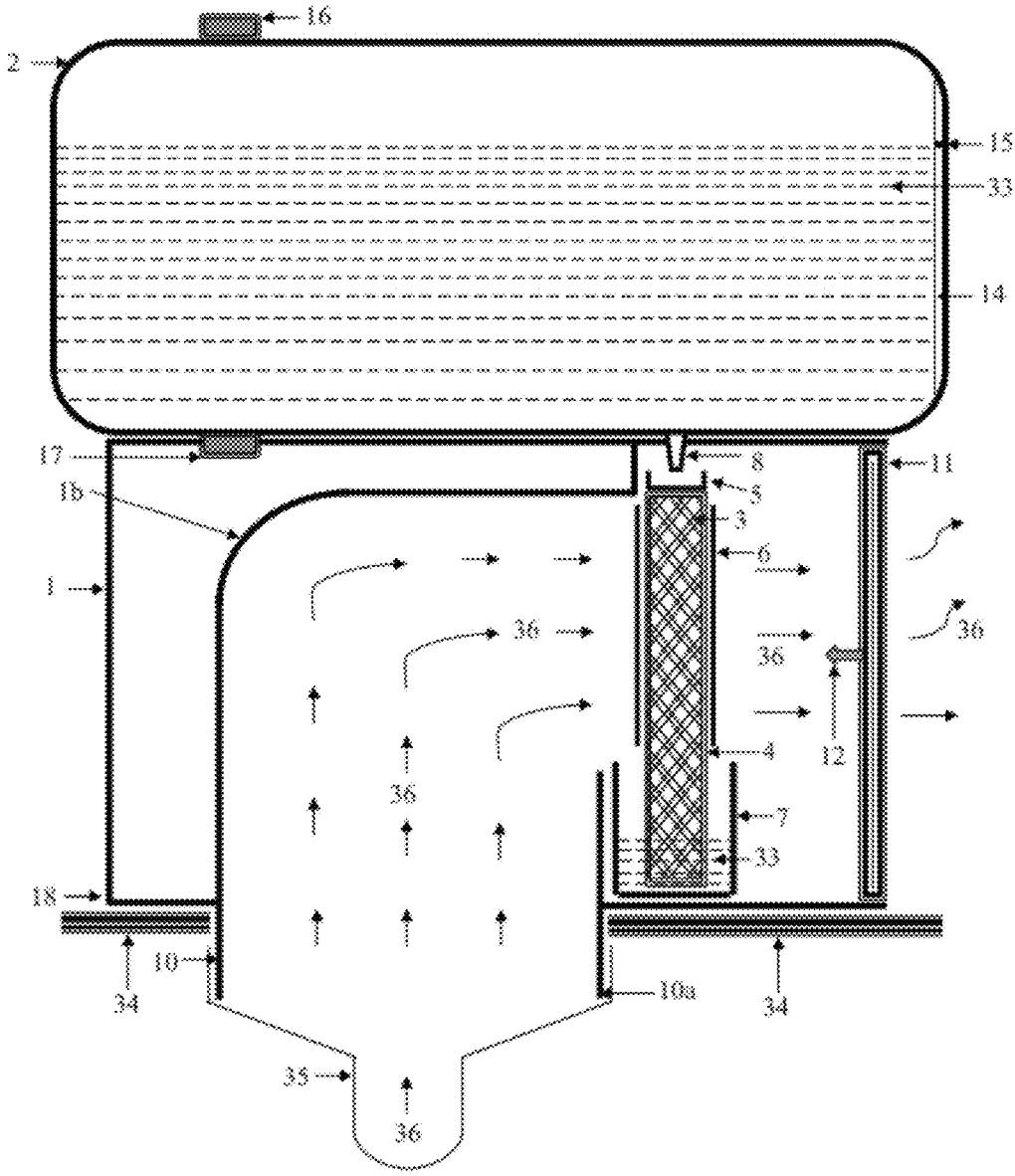
FIG. 3 is a sectionalized side elevation of the first preferred embodiment of this invention, located on a floor vent opening.
Figure 10:
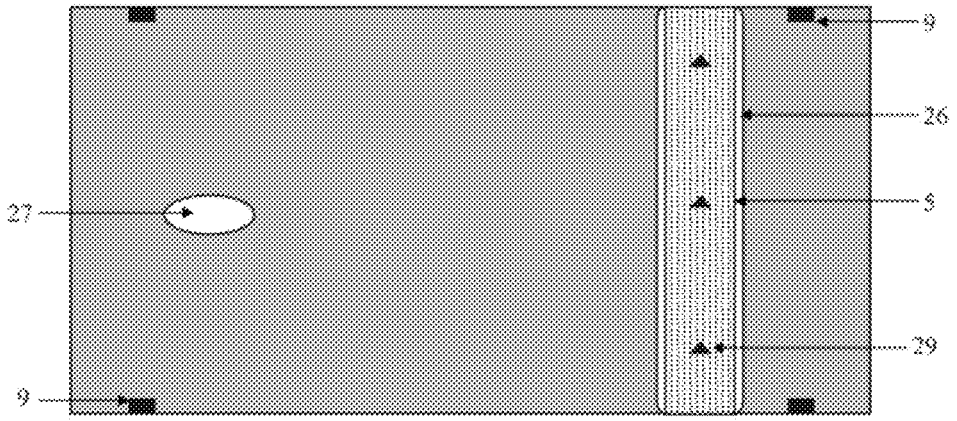
FIG. 10 is a top plan view of the casing of the first preferred embodiment with main water tank removed from the casing.

The bottom of the casing (1) has an air inlet base (10) having a flange (10*a*) which goes directly into the room air vent (35) as shown in FIG. 2. A curved upper extension (1*b*) of the base of the casing (1) acts as a deflector to guide the vertical hot air flow (36) and to deflect it horizontally through a main corridor of the humidifier and into evaporative filter element (3), increasing the efficiency of the humidifier. Casing (1) has a humidifier seating base (18), which seats the humidifier to the room floor. Right next to air inlet base (10) at the bottom of casing (1) is the lower water pan (7) in which the evaporative filter element (3) sits. Casing (1) has a hollow opening (26) at the top which, as shown in FIG. 10, is slightly bigger than the length and thickness of the evaporative filter element (3), to allow the latter to slide in from the top. This casing hollow opening (26) at the top is also necessary for the water tank pin holes (8) to drip water onto evaporative filter element frame distribution trough (5) and onto evaporative filter element (3). As also seen in FIGS. 1 and 10, casing (1) has on its top a bottom water inlet cap aperture (27) for the projecting bottom water refill inlet and cap (17) of the main water tank (2) to seat in properly when water tank (2) is fixed on top of the casing. Casing (1) also has two click (or detent) grooves (not shown) on the front side walls for the air outlet grill (11) to attach at the front of casing (1) with an air outlet click tab (12) on the grill.

Figure 5:
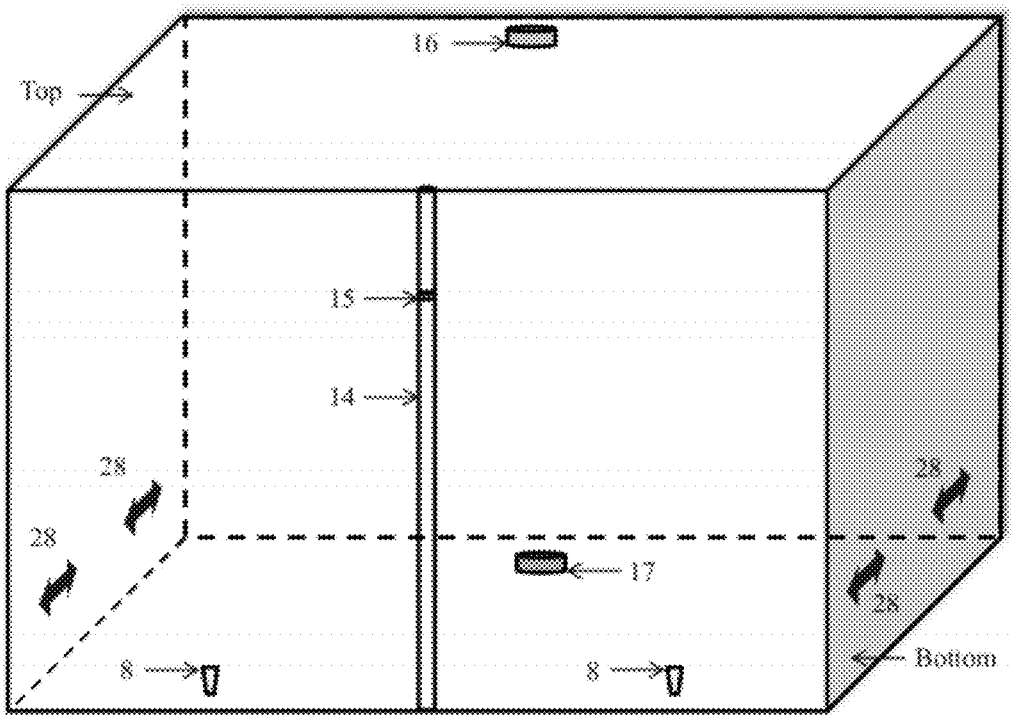
FIG. 5 is an isometric view of the main water tank of the first preferred embodiment of this invention as illustrated in FIG. 1, showing diagrammatically the top and bottom components for clarity.

Main water tank (2), as illustrated in FIG. 5, can be made in different shapes and sizes for appealing looks and water capacity. The shape or size of the main water tank (2) does not affect the operation of the unit. Main water tank (2), which can also be made out of plastic, is attached to casing (1) by a water tank click tabs (9) on the casing (1), as shown in FIG. 1 and can be easily detached with a slide and un-click for refilling with water (33). As shown in FIG. 5, main water tank (2) also has four complementing and projecting water tank tabs (28) to click into the casing's water tank click tabs (9)—two on each side of the tank. After filling, main water tank (2) can be re-attached easily to the casing (1) by sliding in the reverse direction and clicking in place with the water tank tabs (28) clicking into engagement with water tank click tabs (9) on the casing (1). The water tank is equipped with a transparent water level indicator tube (14) shown in FIG. 3, and a colorful moving float inside the transparent water level indicator tube which is the water level indicator (15). This enables the user to monitor the water level and know when the tank is empty and needing a refill. Another option is to manufacture the whole of main water tank (2) with rigid transparent plastic material. This way user can monitor water level directly from main water tank (2), so that it does not need to be equipped with water level indicator tube (14) and water level indicator (15).

Main water tank (2) is equipped with top and bottom refill inlets having respectively caps (16) and (17) to allow refilling of the water tank in two ways—a) without detaching main water tank (2) from the casing (1) by refilling through top water refill inlet and cap (16) using a water container; or b) by detaching main water tank (2) from the casing (1) and refilling from a water source through bottom water refill inlet and cap (17). Main water tank (2) is designed to be airtight when both the refill caps (16) and (17) are properly tightened. At the bottom of the main water tank (2) there are two water tank pin holes (8) designed to drip water into evaporative filter element (3) and moisten it. Water tank pin holes (8) are positioned just above the evaporative filter element frame trough (5) for the water to drip properly into the trough then pass into evaporative filter element (3) itself via holes (29) seen in FIG. 10. Water tank pin holes (8) are holes of a minute size such that water will only drip drop by drop and is calibrated for optimum result so as not to cause the lower water pan (7) to over flow during operation.

Figure 7:
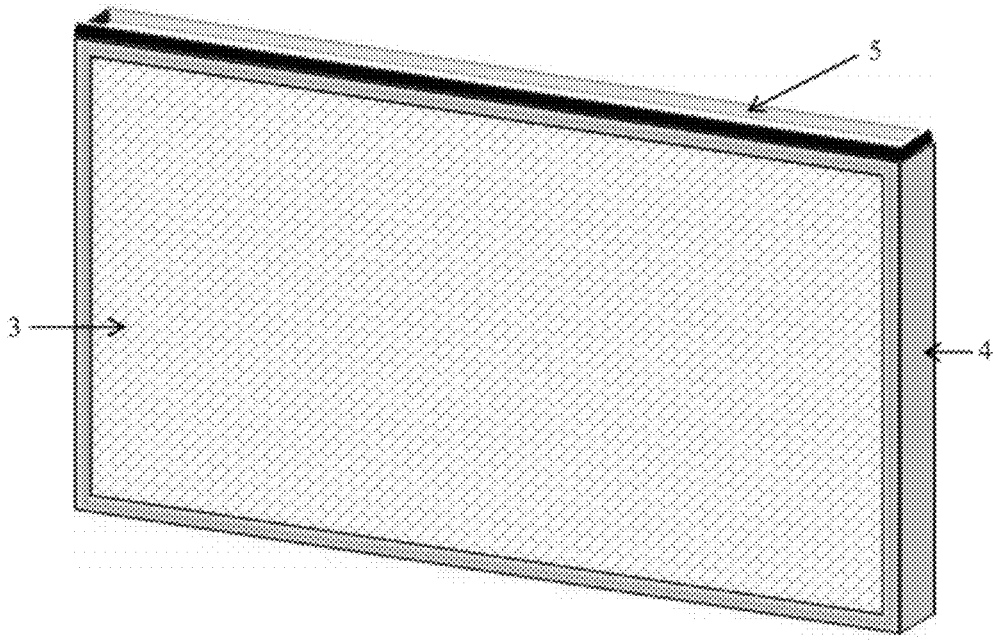
FIG. 7 is an isometric front view of the evaporative filter element suitable for the embodiments of this invention as illustrated in FIG. 1, FIG. 4, FIG. 11 and FIG. 13.

The evaporative filter element assembly, as illustrated in FIG. 7, consists of evaporative filter element (3) and its frame (4). Evaporative filter element (3) is made of standard absorbent humidifier wick filter material made of layers of wood pulp fiber with cells in a honey comb formation for free air flow. This wood pulp fiber is highly absorbent and has excellent capillary action to moisturize the evaporative filter element (3) continuously. Evaporative filter element (3) is enclosed in evaporative filter element frame (4) made of plastic for rigidity and to withstand the air flow through it. The top side of the evaporative filter element frame (4) is the evaporative filter element frame trough (5) which collects the water dripping from water tank pin holes (8) and passes this to evaporative filter element (3) efficiently. Evaporative filter element frame trough (5) has multiple evaporative filter element trough holes (29) in it to distribute water onto evaporative filter element (3) evenly; these holes (29) extend all the way to absorbent material of evaporative filter element (3). Two evaporative filter element holders (6) in the form of opposed sliding channels are fabricated on both opposed inner sides of the casing (1) for evaporative filter element (3) to slide in from the top of the casing (1) through casing hollow opening (26), for maintenance and replacement. These sliding channels hold the evaporative filter element (3) tightly in place without the help of any nuts and bolts during the operation of humidifier. Evaporative filter element (3) covers the entire width and height of the air flow corridor of the apparatus, thus forcing all of the air to pass through it for maximum efficiency.

Figure 8:
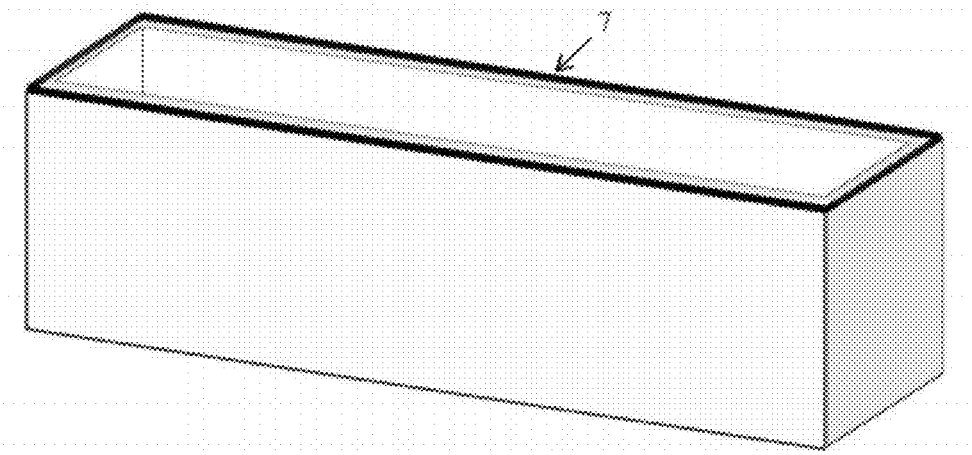
FIG. 8 is an isometric front view of the lower water pan suitable for the embodiments of this invention as illustrated in FIG. 1, FIG. 4, and FIG. 11.

The lower water pan (7), as illustrated in FIG. 8, is a deep tray made of plastic which seats the evaporative filter element (3) and surrounds its lower edge portion. Water pan (7) will collect and store any excess water dripping through the evaporative filter element (3). The left-over water collected in the secondary, lower water pan will rise by capillary action along the absorbent material of the evaporative filter element keeping it continuously moistened for the proper function of the humidifier.

Figure 6:
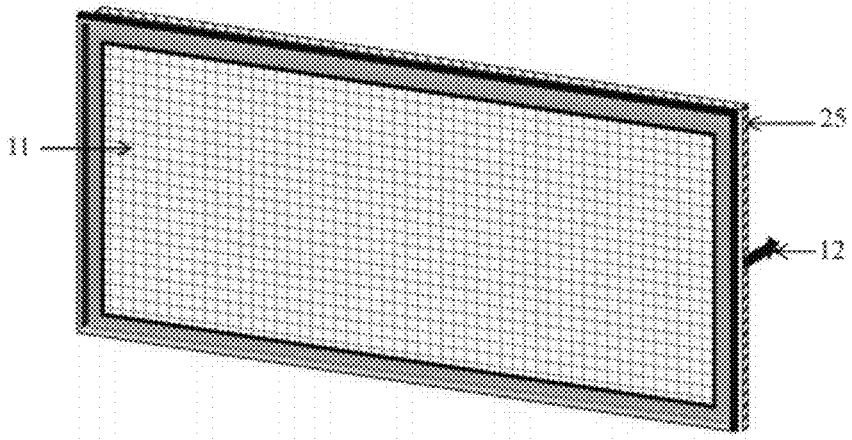
FIG. 6 is an isometric front view of the air outlet grill which can be employed for the embodiments of this invention as illustrated in FIG. 1, FIG. 4, FIG. 11 and FIG. 13.

Air outlet grill (11), as illustrated in FIG. 6, is a protective cover made of plastic and fixed at the air outlet exit of the casing (1). Grill slide shutter (25) is a sliding grill plate attached to the interior side of the air outlet grill (11) for closing or adjusting the air flow through humidifier. Air outlet grill (11) is fixed on to the front end of the casing (1) with the air outlet grill click tab (12).

Casing (1) is the one piece main structure which holds other components of the humidifier together.

Assembly and Installation:

Lower water pan (7) is installed first at the bottom of the casing (1), under the casing hollow opening (26), by sliding through the front end of the casing. Evaporative filter element (3), assembled in its frame, is slid through the casing hollow opening (26) from the top of the casing and held by the sliding channels (6). When inserted properly, evaporative filter element (3) will sit well inside the water pan (7). Then the casing can be closed by installing the air outlet grill (11) to the front end of the casing (1) with the air outlet grill click tab (12). The humidifier can be now installed into the room air vent by removing the room air vent cover and fixing the room vent humidifier in its place. Filling of the main water tank (2) can be done from a water source through bottom water refill inlet and cap (17), after which the cap should be tightened properly. Finally, the main water tank (2) is installed on the casing (1) by sliding and clicking water tank tab (28) of main water tank (2) into water tank click tabs (9) of the casing. The room vent humidifier is then ready for operation.

Maintenance:

This humidifier does not require any complex routine maintenance process to keep it running. It only needs yearly cleaning of the lower water pan (7) to empty the water residues and minerals. This can be done by sliding it from the front end, after removal of the filter element, and washing it under running water. Evaporative filter element (3) needs to be replaced with a new one whenever it becomes clogged. The evaporative filter element assembly can be taken out of the casing (1), after removal of the main tank, by simply sliding and lifting the filter element through the casing hollow opening (26) on top of the casing (1). Air outlet grill (11) needs occasional cleaning of dust which gets accumulated on it from the air flow. This can be done by detaching the air outlet grill (11) from casing (1) and brushing off the dust.

For off seasons, where humidifying is not required, the apparatus can be removed from the room vent by just lifting it out of the vent and putting it away for storage. At these times a normal passive vent cover can be fixed on to the room vent.

Operation:

The preferred embodiments of this invention as illustrated in FIGS. 1 to 10 operate as follows: The humidifier is assembled as described above in the assembly section and installed into the room air vent by removing the room air vent cover and fixing the room vent humidifier in its place. Main water tank (2) is filled to the desired level with water (or other suitable liquid) and cap (16) is secured on refill inlet filler to seal the water tank air tight. When main water tank (2) is properly fixed onto casing (1), water will start to drip through two water tank pin holes (8) as discussed above. The water that drips through water tank pin holes (8) is first collected in evaporative filter element frame trough (5) and emitted evenly to evaporative filter element (3) through multiple evaporative filter element trough holes (29). Any extra water which is spilled from evaporative filter element (3) is collected and stored by lower water pan (7). This lower reservoir of water will keep the evaporative filter element (3) moist throughout the operation by capillary action. When the air source blows the hot air through the vent, it is received by air inlet base (10) and directed to the air corridor of the humidifier. The air corridor of the humidifier is designed in such a way that the hot air is passed through evaporative filter element (3) before exiting the humidifier. The moisture in the evaporative filter element (3) increases the humidity of the air as its passes through evaporative filter element (3), thus increasing the humidity of the room.

The humidity level of the surroundings of this room vent humidifier is naturally and automatically controlled by using the ON and OFF cycle of air flow from the heat source as described above. The humidifier will humidify its surroundings during ON cycle mode of heat source by moisturizing the air passing through evaporative filter element (3), and water consumption will be high. In the OFF mode, the evaporation rate of the filter element and water consumption will be low and will allow more water to drip into the lower water pan which will accumulate water. It is important to keep the heat source in air circulation mode so that there will be continuous ON/OFF cycles to ensure proper functioning of the humidifier. The air circulation mode also keeps the inside air quality very high.

Figure 4:
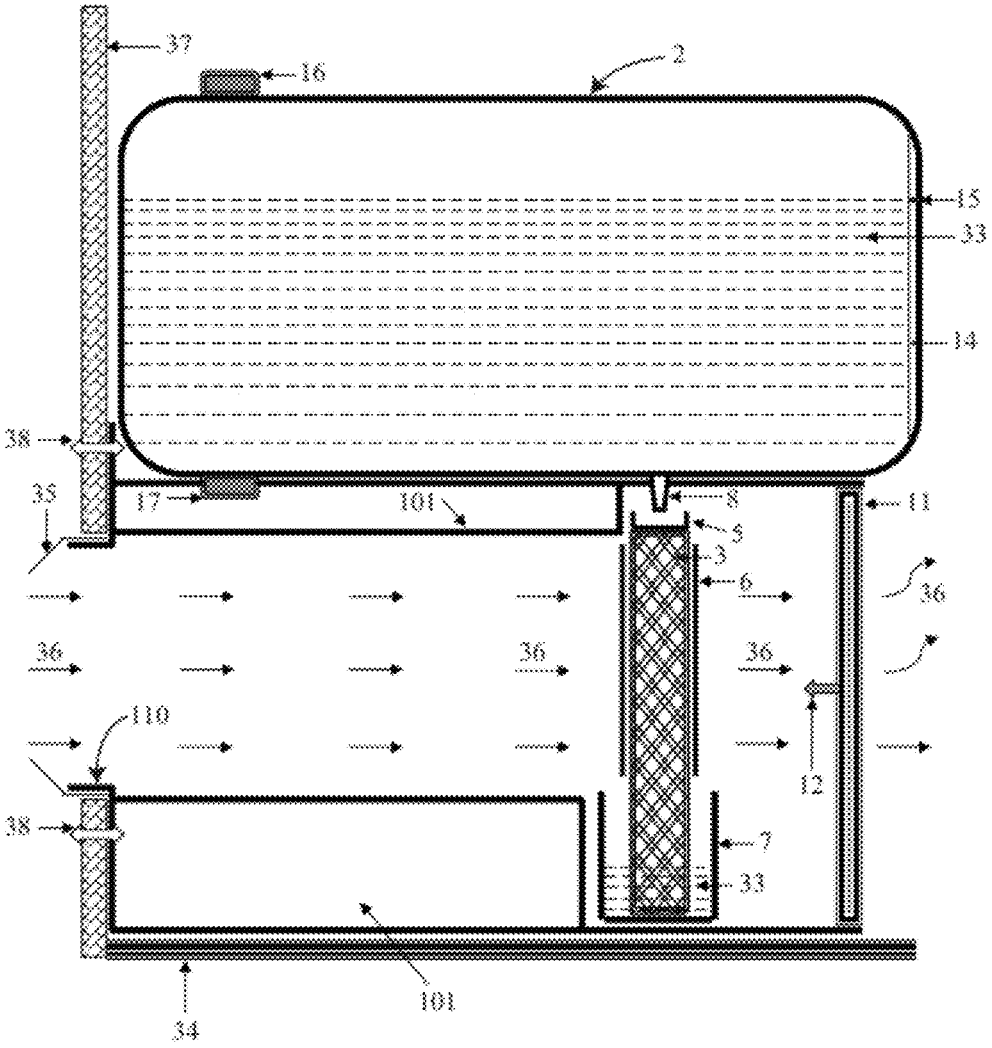
FIG. 4 is a sectionalized side elevation of a second embodiment of this invention suitable for a wall vent opening.

As illustrated in FIG. 4, the humidifier of this Embodiment 2 can be fixed onto a wall vent opening. In this installation, air inlet base (110) is attached to the room wall (37) instead of room floor vent (34) to direct the air flow (36) to evaporative filter element (3). The air corridor is a horizontal straight hollow opening and does not have any air deflector. The casing (101) is fixed on to the room wall (37) with the help of fixing screws (38). The components, installation and operation of the unit remain same as the preferred embodiment except for the above explained differences.

Figure 9:
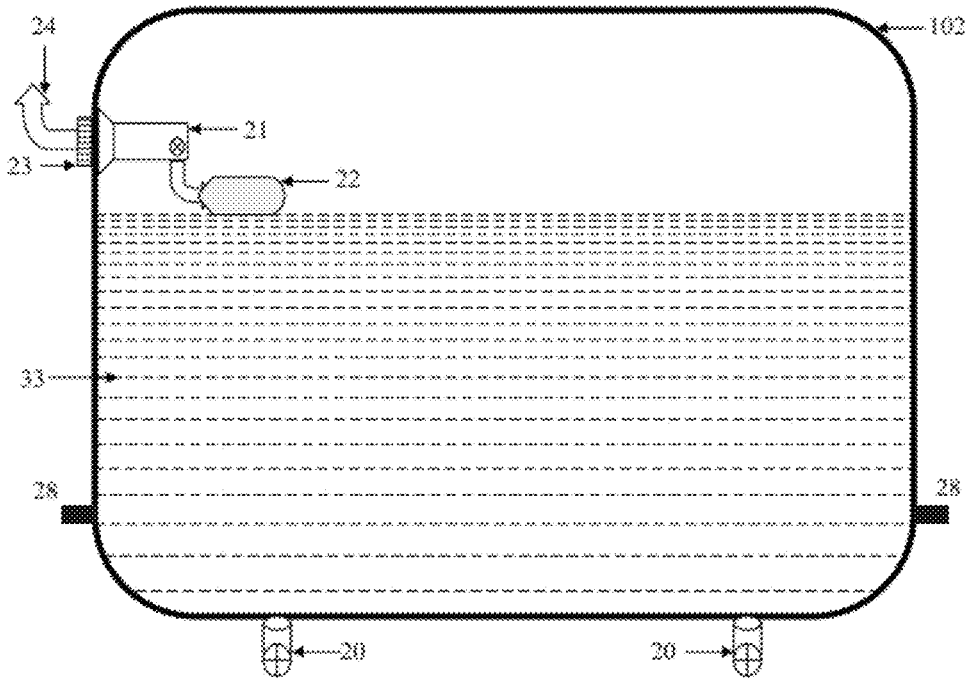
FIG. 9 is a sectionalized front view of an optional embodiment of a main water tank which can be employed with this invention.

Optional embodiment of main water tank (102):

FIG. 9 illustrates an optional main water tank (102) that can be employed within certain embodiments of this invention including the first embodiment. Two major differences in this optional main water tank (102) from main water tank (2) of the first embodiment are:

1) Use of a float valve assembly (21) to fill the water tank (102) and keep the water level in the main water tank (102) to a certain level without any human intervention.

2) An ambient temperature controlled valve or air flow controlled valve (20) to drip water only during the air flow and precisely control the water dripping from the main water tank (102).

In this optional main water tank (102) variation, the tank is always connected to continuous water supply through water line (24), and the water tank has a hole in the side to accommodate water line 24. Water level in the tank (102) is controlled by the float valve assembly (21) attached to the water line (24) inside the tank with valve fixing nut and bolt (23).

The air float (22) is filled with air so it always floats on top of the water. The position of the air float (22) determines the water level inside the main water tank (102). At the time of installation, water supply is opened and water is allowed to flow into main water tank (102) and fills up the tank. When water level reaches the maximum level determined by the air float (22), the air float (22) is pushed up in its pivotal screw causing opening of the float valve assembly (21) to shut off, closing the water flow through water line (24) to main water tank (102). When water level goes down, the air float (22) will swing down slightly in its pivotal screw, opening up the float valve assembly (21) for the water to come in and increase the water level. This float valve assembly (21) together with air float (22) and water line (24) keeps the water level inside the main water tank (102) at a pre-determined level without any human intervention. In this optional embodiment casing (1) does not need the bottom water inlet cap groove (27) on top since optional main water tank (102) is not fitted with bottom water refill inlet and cap (17); nor does it have the top water refill inlet and cap (16) of the previous embodiments. Float valve assembly (21) is just like any other generic float valve available in the market and does not warrant any further explanation and is considered to be out of the scope of this invention.

Another feature of this optional main water tank (102) embodiment is an ambient temperature controlled valve or air flow controlled valve (20) fixed onto water tank pin holes (8) for controlling the water dripping from the main water tank (102) onto evaporative filter element (3). This way water tank pin holes (8) will open up only when heated air passes through the air corridor of the humidifier. Water dripping from water tank pin holes (8) in this embodiment is directly linked to the heated air flow and can withstand irregular ON/OFF cycles of the heated air source. Ambient temperature controlled valve or air flow controlled valve (20) is an off-the-shelf product readily available from the market and doesn't warrant any further explanation and considered to be out of the scope of this invention.

This optional main water tank (102) variation with the float valve assembly (21) and a water supply line is mainly useful in commercial building deployments of this invention where large areas of rooms need to be humidified and consumption of water will be high. This will avoid frequent human intervention in the operation and refilling of main water tank (102). This enables the humidifiers according to this invention to operate over a long time span without the need for any human attention, except for seasonal cleaning or changing of the evaporative filter element (3). Ambient temperature controlled valve or air flow controlled valve (20) is also ideal for commercial deployments of this invention.

Embodiment 3 of this invention is designed to give air flow in line with the standards of some countries. The main difference of this embodiment compared to the previous embodiments is the way hot air comes out of the humidifier. In this embodiment, hot air is coming out of two sides of the apparatus instead of the front as in the preferred embodiment.

Figure 11:
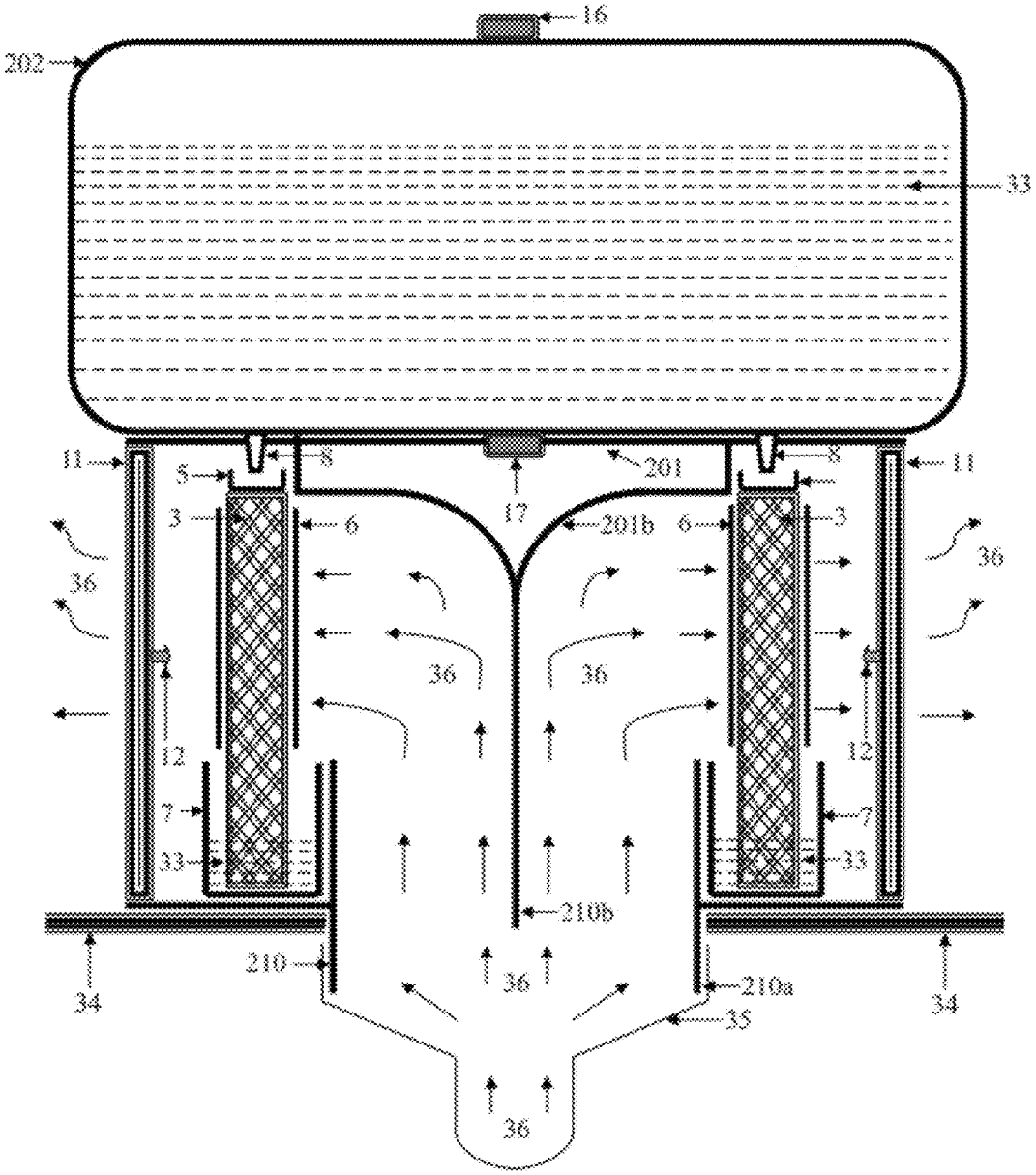
FIG. 11 is a sectionalized front elevation of a third embodiment of this invention with a sectional view of the main components inside.
Figure 12:
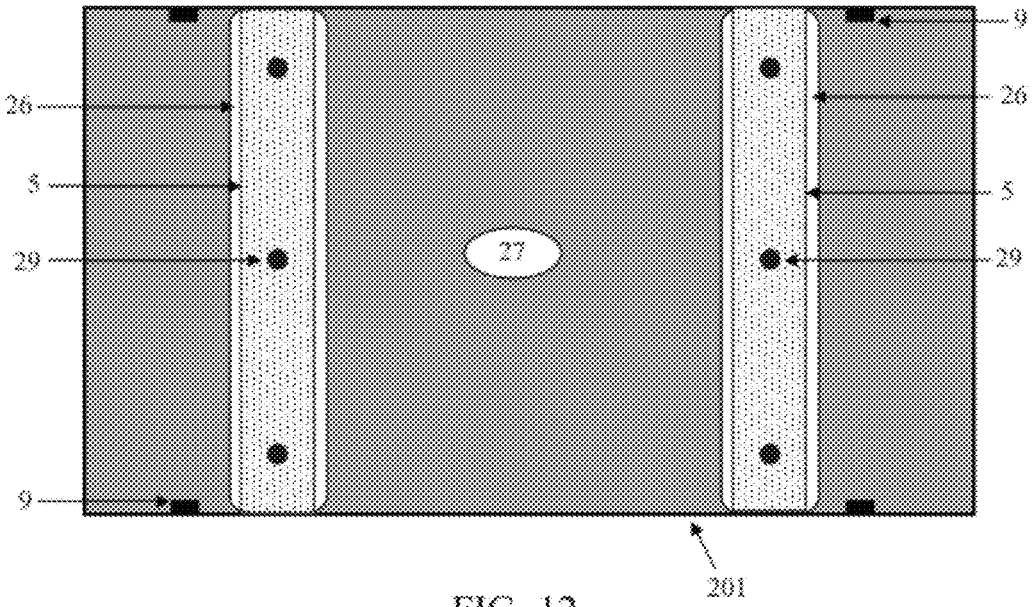
FIG. 12 is a top plan view of the casing with main water tank removed from the casing for the third embodiment of this invention as illustrated in FIG. 11.

FIG. 11 and FIG. 12 show respectively a sectionalized front view of this embodiment, and a top plan view of the casing (201) without main water tank (202). The main purpose of this embodiment is to direct air flow through the sides of the humidifier and to the sides of the room rather than only through the front of the humidifier.

In Embodiment 3, many of the components of the invention remain the same as the preferred embodiment explained above and used in the exact same context; however the following components are duplicated:

Evaporative filter element (3)

Evaporative filter element frame distribution trough (5)

Lower water pan (7)

Air outlet grill (11)

Casing hollow opening (26)

Casing air corridor

Air outlet grill click tab mechanism on the casing (201).

Also the following design modifications are made to casing (201) and the main water tank (202).

Casing (201) has two air outlet openings on the sides, rather than one on the front. Similarly, there are two air outlet grills (11); incoming air is deflected out of these openings by casing deflector portions (201*b*). Casing (201) is wider than in the first embodiment, and needs more space to accommodate two lower water pans (7), one on each side. The bottom water inlet cap aperture (27) of the casing (201) will be on the center of the casing top.

Main water tank (202): There are four water tank pin holes (8) to supply water to the two evaporative filter elements (3). Two water tank pin holes (8) on one side will spread the water for one evaporative filter element (3). The other two water tank pin holes (8) on the other side will emit the water to other evaporative filter element (3).

It will be seen that the design of the humidifiers described herein is modular in the sense that many of the identical components can be used for different embodiments.

Operation:

Embodiment 3 of this room vent humidifier invention is very similar in its operation to the first embodiment; it uses air flow from a heat source for its operation, and also has no electrical component.

Embodiment 3 of this invention as illustrated in FIGS. 11 and 12 operates as follows: The humidifier is assembled as described and installed into the room air vent by removing the room air vent cover and fixing the room vent humidifier in its place on the room vent. Main water tank (202) is filled to the desired level with water (or other suitable liquid) and cap (16) is secured on refill inlet filler to seal the water tank air tight. When main water tank (202) is properly fixed onto casing (201), water will start to drop through four water tank pin holes (8) onto two of the evaporative filter elements (3). The water that drips through water tank pin holes (8) is first collected in the each evaporative filter element frame trough (5) and emitted evenly to its respective evaporative filter element (3) through multiple evaporative filter element trough holes (29). Any extra water which is spilled through evaporative filter element (3) is collected and stored by lower water pans (7). These reservoirs of water will keep the evaporative filter elements (3) moist throughout the operation by capillary action. When the air source blows the hot air through the vent, it is received by air inlet base (210) and directed evenly through two air corridors of the humidifier by deflector portions (201*b*), so that the hot air is passed through evaporative filter elements (3) before exiting the humidifier. The moisture in the evaporative filter elements (3) increases the humidity of the air as its passes through evaporative filter elements (3) on both the sides.

Embodiment 4 of this invention works the same way as preferred Embodiment 1 but is designed to give main water tank (302) more control of the water passed on to the lower water pan (307) by employing a spring operated valve (31) at the bottom of an extension (302*a*) of the main water tank (302). The main difference of this embodiment compared to the first embodiment is the way water is passed on to the lower water pan (307) and emitted to the evaporative filter element (3). The evaporative filter element (3) mainly absorbs moisture from its bottom portion through capillary action of water from lower water pan (307).

Figure 13:
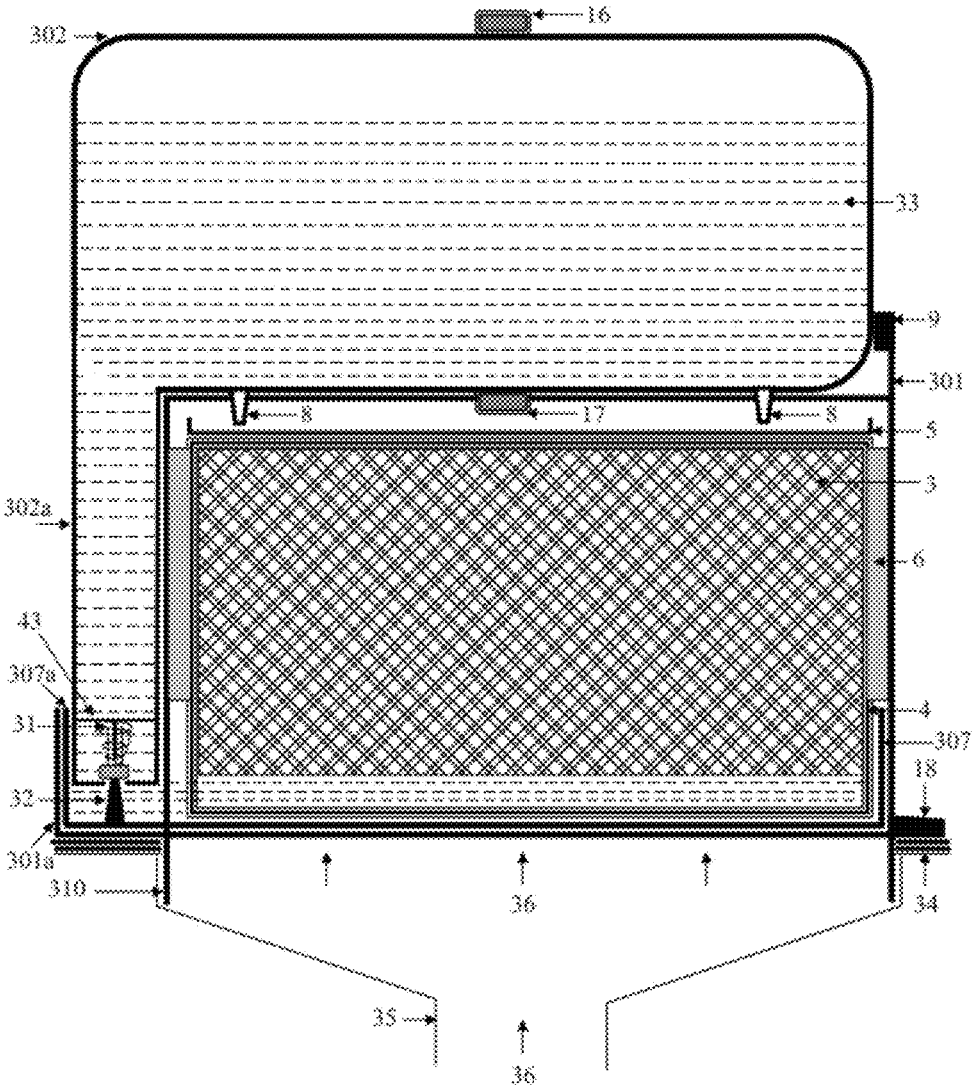
FIG. 13 is a sectionalized elevation of a fourth embodiment with sectional view of components in the front plane.

FIG. 13 shows a front elevation of the casing (1) with main water tank (302) of Embodiment 4. The main purpose of this embodiment is to direct water flow directly to lower water pan (307) and control it so that lower water pan (307) will get filled only to a certain level and will never over flow.

In Embodiment 4, all the main components of the invention remain the same as the first embodiment explained above and used in the exact same context. The only differences are the deployment of an additional component, a spring operated valve (31) at the bottom of a side extension (302*a*) of the main water tank (302). Also, the casing (301) and the lower water pan (307) are modified to fit the new design. Specifically, the components are modified as follows:

Casing (301): the bottom of the casing is extended to the side, and the casing has an opening in the side to accommodate a side extension (307*a*) of the lower water pan (307).

Main water tank (302): the main water tank has a drop down extension (302*a*) which reaches down to the lower water pan extension (307*a*), and it is also equipped with the spring operated valve (31) at the bottom to regulate the water flow.

Figure 14:
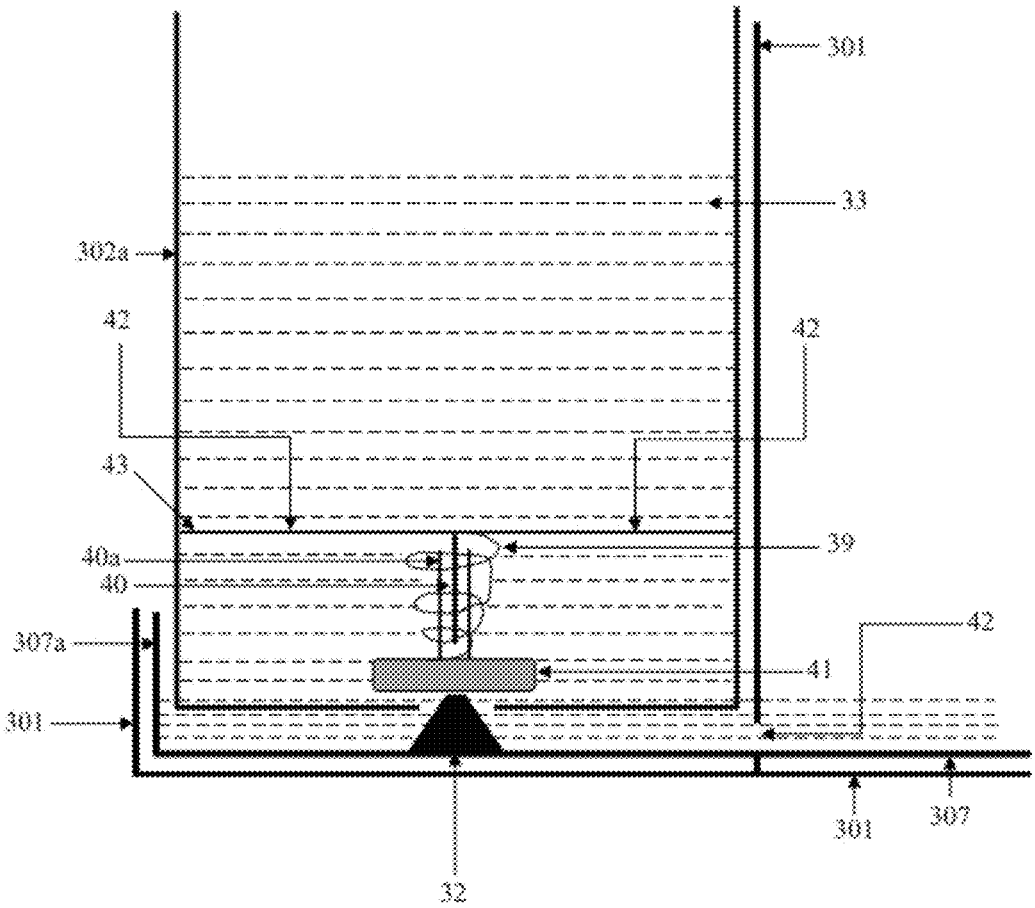
FIG. 14 is the illustration of the spring operated valve mechanism of the fourth embodiment of this invention.

Lower water pan (307): this lower water pan is slightly lengthier than the width of the casing (301) and has its side extension (307*a*) projecting outside of the casing to accommodate the drop down extension (302*a*) of the main water tank (302) and to seat the spring operated valve (31). The bottom of extension (307*a*) has an upwardly projected post (32) to push open the spring operated valve (31) when it comes in contact with it. As shown in FIG. 14, the wall of casing (301) also has a water hole (42) on the side for the water to flow throughout the length of the lower water pan (307).

Operation:

Embodiment 4 of this room vent humidifier invention is very similar in its operation to previous embodiments in that it uses the air flow of the heat source for its operation, and has no electrical component.

Embodiment 4 of this invention as illustrated in FIGS. 13 and 14 operates as follows: The humidifier is assembled as described above and installed into a room air vent by removing the room air vent cover and fixing the humidifier in its place. Main water tank (302) is filled to the desired level with water (or other suitable liquid) and the cap (16) is secured on refill inlet filler to seal the water tank air tight. When the main water tank (302) is detached from casing (1) to fill water, the spring operated valve (31) will keep the valve closed and there will not be any water flow from main water tank. When main water tank (302) is properly fixed onto casing (1), projected post (32) of the lower water pan (307) will push the rubber valve member (41) of the spring operated valve (31) up, opening the valve, and water will start passing to lower water pan (307) through hole (42). Water flow will stop when the water level reaches the same level as the bottom of the main water tank extension (302*a*), because of the partial vacuum which occurs in the main water tank (302) when the water surrounding the lower end of extension (302*a*) prevents air from entering the tank, thus keeping water level of the lower water pan (307) to a consistent level without overflowing it. Evaporative filter element (3) sitting in lower water pan (307) will get moist through capillary action and humidify the air passing through it.

When the air source blows the hot air through the vent, it is received by air inlet base (310) and directed evenly through the air corridor of the humidifier. The air corridor of the humidifier includes deflectors so that the hot air passes through evaporative filter element (3) before exiting the humidifier. The moisture in the evaporative filter element (3) increases the humidity of the air as its passes through evaporative filter element (3). As more water is absorbed into evaporative filter element (3) and water level in lower water pan (307) becomes lower than the bottom of the main water tank extension (302*a*), air can enter the tank and water will again start flowing from main water tank (302) to lower water pan (307), and will again stop when the level of water (33) in the lower water pan (307) reaches the bottom level of main water tank extension (302*a*), as described., keeping the water level of the lower water pan (307) always consistent.

FIG. 14 shows the working of spring operated valve (31) mechanism in detail. Spring operated valve (31) is fixed on a partition (43) close to the bottom inside of the extension (302*a*) of the main water tank. In this partition (43) are many holes (44) which allow water (33) to seep through to the bottom of the water tank extension (302*a*). The valve stem (40) is a two part mechanism with an inside stem fixed to the partition (43), and a moving outer sleeve (40*a*). The valve spring (39) is fixed around the moving outer sleeve (40*a*). One end of the valve spring (39) is fixed to the partition (43) and the other end to rubber valve member (41) which is mounted on the lower end of the moving outer sleeve (40*a*), and which is pushed by valve spring (39) to keep closed the main water tank (302) when it is detached from casing (301). When the main water tank (302) is placed on the casing (301), projected post (32) in the lower water pan (307) will push valve spring (39) and rubber valve member (41) up to open up the valve (31). This will discharge the water (33) from main water tank (2) into lower water pan (307) to a level which is equal to the bottom of the main water tank extension (302*a*), and will maintain this level as described above.

Embodiment 5 of this invention works on generally similar principles as previous embodiments and has some similar components. The main difference of Embodiment 5 over previous embodiments is the way air flow (36) is directed relative to the evaporative filter element. In this embodiment, the hot air flow (36) is passed along a curved evaporative filter element (403), as discussed below with reference to FIG. 20, instead of passing through a porous filter element (3). The curvature of the evaporative filter element (403) towards the air outlet ensures maximum contact for the hot air with evaporative filter element (403) to moisturize air flow (36) and to deflect it towards front and upper air outlet grills (411*a*) and (411*b*). The bottom of the main water tanks (402) are seated in the lower water reservoir (407). This embodiment also has a spring operated valve (431), described below, at the bottom of each of two main water tanks (402) to control the water flow; as with Embodiment 4 this gives good control of water flow. This embodiment also works in similar manner as the previous embodiments but is designed to give unobstructed passage to hot air flow (36) and at the same time moisturize the hot air by allowing it to come in contact with evaporative filter element (403). In this embodiment, water (33) is passed on to the lower water reservoir (407) when the water (33) in the lower water reservoir (407) falls below a pre-determined level decided by the lower edge of the main water tanks (402). Evaporative filter element (403), which is made of highly absorbent wood pulp fiber, absorbs moisture from the bottom through capillary action of water from lower water pan (407*a*) which communicates with reservoir (407).

Figure 15:
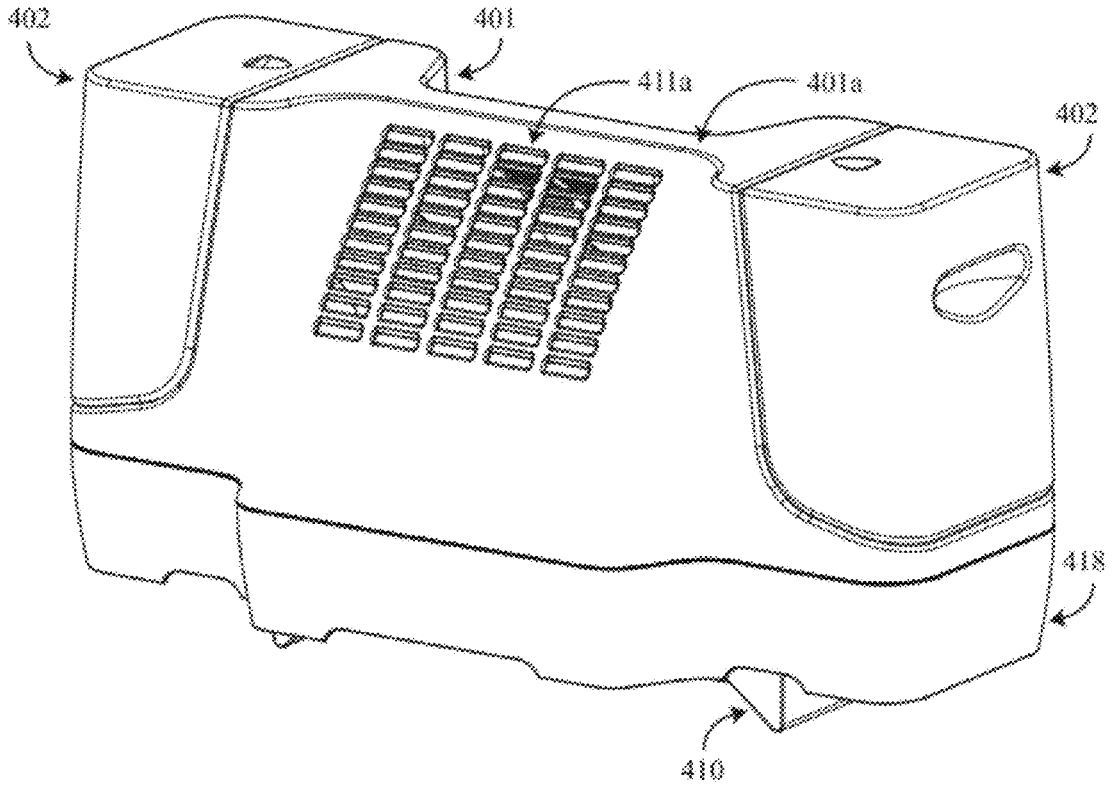
FIG. 15 is isometric overview of a fifth embodiment of the inventions.

FIG. 15 shows the Embodiment 5 with all the components assembled for operation.

Figure 16:
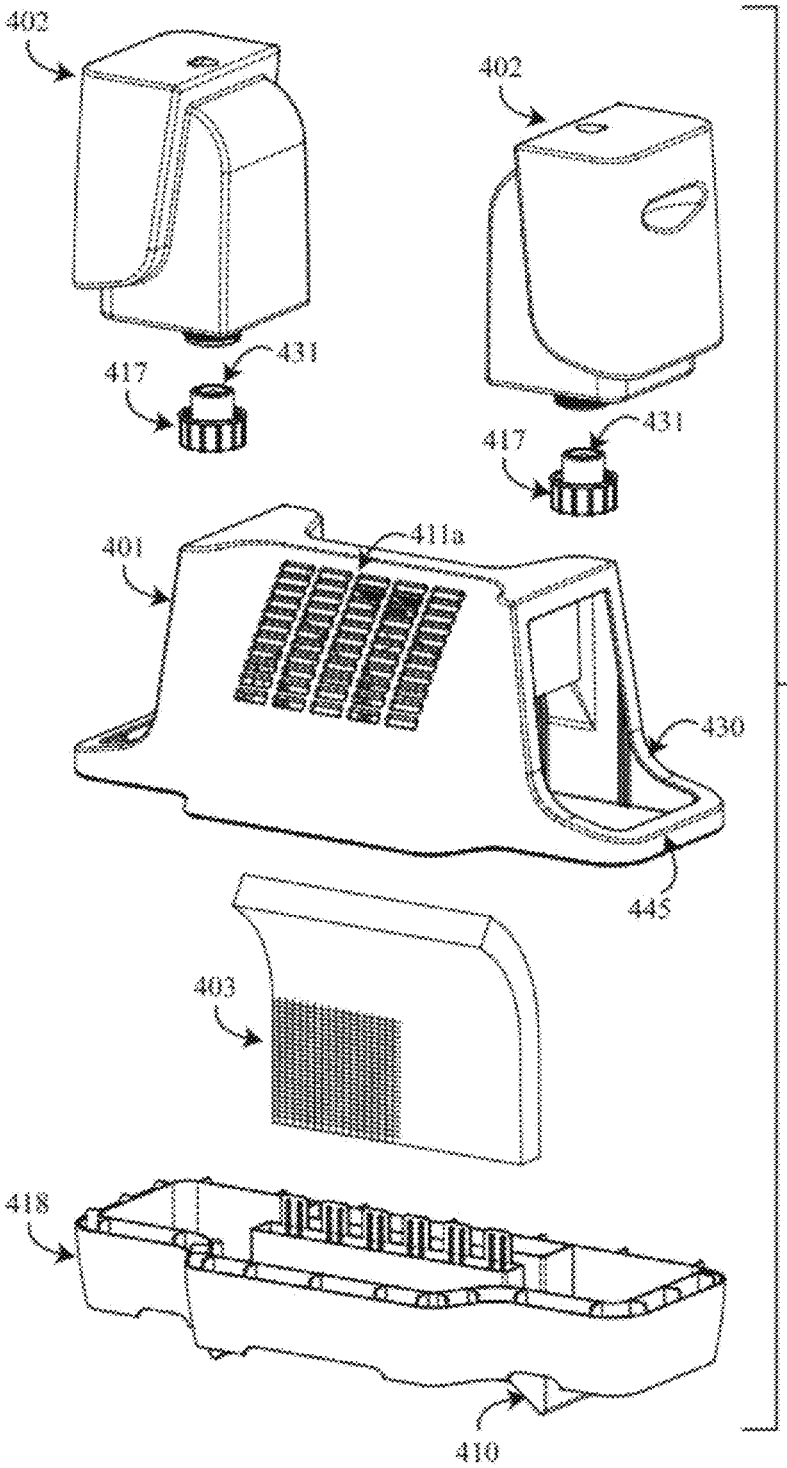
FIG. 16 illustrates the parts of the fifth embodiment with all the parts detached including the casing.

FIG. 16 shows an exploded view of the Embodiment 5 with all the parts. The two main water tanks (402) increase the water (33) holding capacity to double and decrease the frequency of refill. Main water tanks (402) are refilled through the bottom water refill inlet and cap (417). Each cap (417) is equipped with an internal spring operated valve (431), described below, to have better control of the water flow and to prevent any water dripping during the carrying of the tanks. Main water tanks (402) are made of clear transparent plastic material to make the water (33) level visible from outside for refills. Main water tanks (402) can be easily detached and attached with a slide in mechanism onto the sides of the upper casing (401). Humidifier seating base (418) holds the lower water reservoir (407) and a lower edge portion of curved evaporative filter element (403). The flange of the air inlet base (410) at the bottom of the humidifier seating base (418) will hold the humidifier securely on the vent opening.

Figure 17:
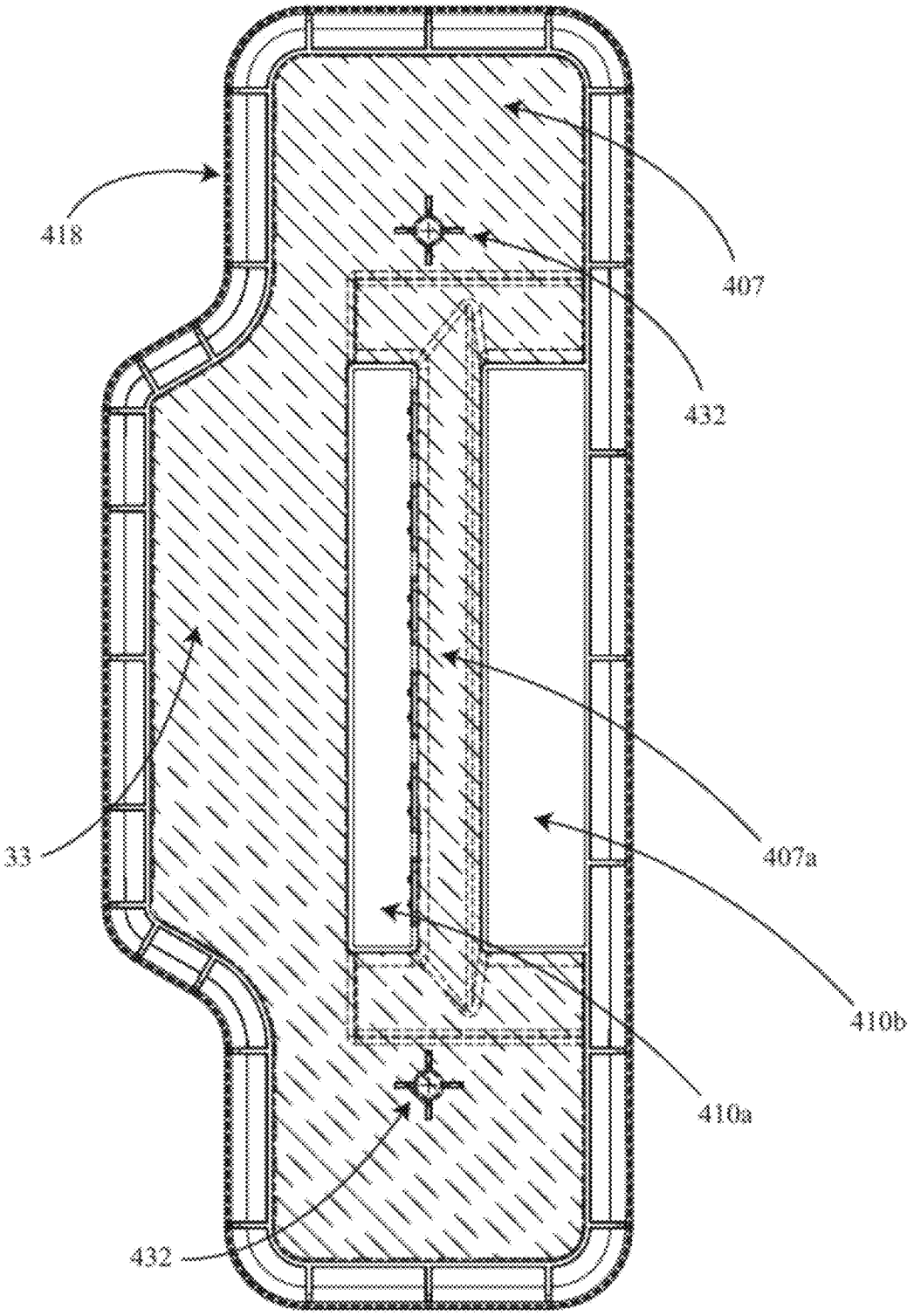
FIG. 17 is a top plan view of a fifth embodiment humidifier seating base, with the lower water pan.

FIG. 17 is the plan view of the humidifier seating base (418) with lower water pan (407) and water (33) in it. The lower water reservoir (407) in this embodiment spreads over a larger area of the humidifier seating base (418) than in the previous embodiments to give added advantage of overall higher water capacity. The lower water reservoir (407) has two projected posts (432) to push open the spring operated valve (431) mechanism as described below. Front and rear rectangular openings (410*a*) and (410*b*) respectively in the humidifier seating base (418) along the vent hole opening of the floor together provide the air inlet base (410) which receives hot air flow (36) to the apparatus without substantial obstruction. Ridges along the perimeter of the humidifier seating base (418) provide the seating base and lower water reservoir (407) extra firm rigidity while holding the water (33) and main water tanks (402).

Figure 18:
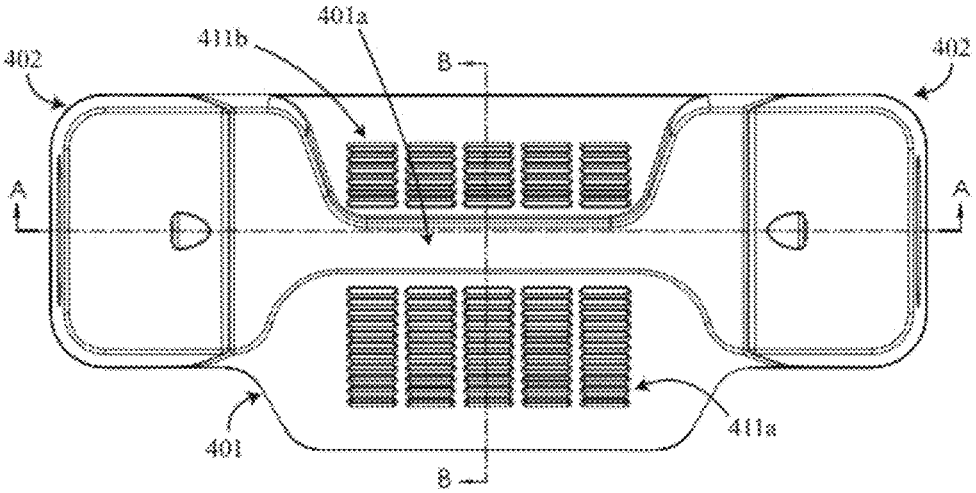
FIG. 18 is a top plan view of the fifth embodiment showing section lines A-A and section lines B-B.
Figure 19:
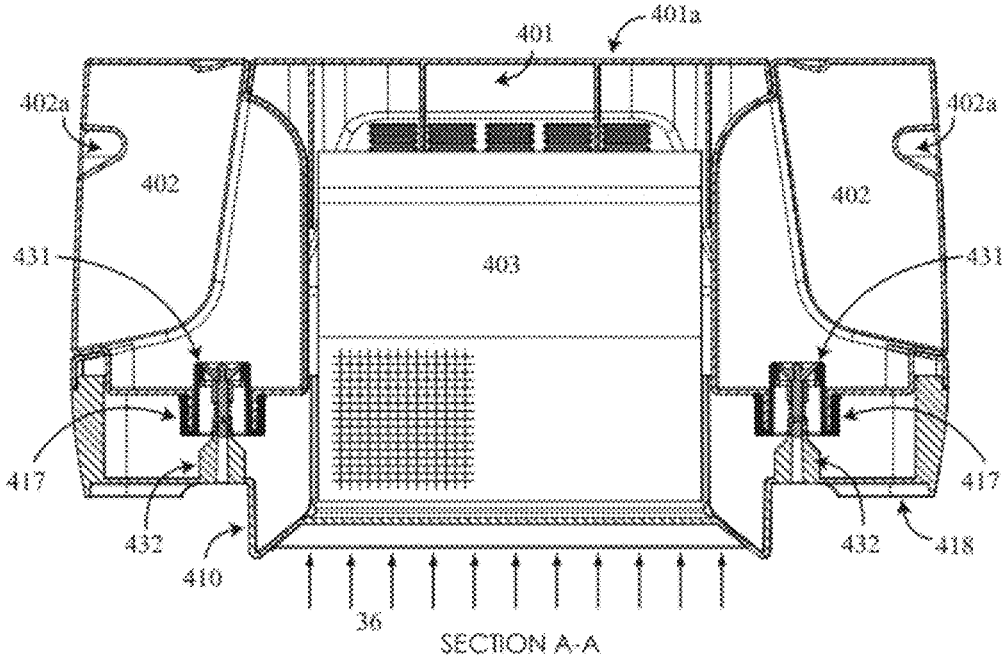
FIG. 19 is the sectional front view along the lines of A-A of FIG. 18 with internal parts of the fifth embodiment.

FIG. 19 is a sectionalized front view along the line A-A of FIG. 18 showing the internal parts of Embodiment 5. The main water tanks (402) each have a dipped concave recess (402*a*) to serve as a handle to allow them to be lifted from casing (401) and carried for refills. Main water tanks (402) rests on recesses at the sides of the upper casing (401) which can hold the weight of the filled tanks. Main water tanks (402) are equipped with threaded water refill inlet caps (417) at the bottom. Main water tanks (402) are refilled through bottom water refill inlet by removal of the caps (417). Each cap (417) is equipped with an internal spring operated valve (431) so that when the cap has been replaced this will keep the tank closed to prevent any water dripping during the portability. The spring operated valve (431) within each cap will only open when seated on the projected post (432) of the lower water reservoir (407). This leak proof safety mechanism is provided to refill the main water tanks (402) without dripping the water during carrying. When a main water tank (402) is placed on the casing (401) after refill and after replacing cap (417), valve stem (440) of the spring operated valve (431) will come into contact with projected post (432) and push open the valve member (441) for the water (33) to flow to lower water reservoir (407). The lower water reservoir (407) will get filled only to a certain level defined by the lower level of the main water tank (402) due to vacuum in the tank thus allowing more controlled water flow and preventing overflow of the lower water reservoir (407).

Figure 20:
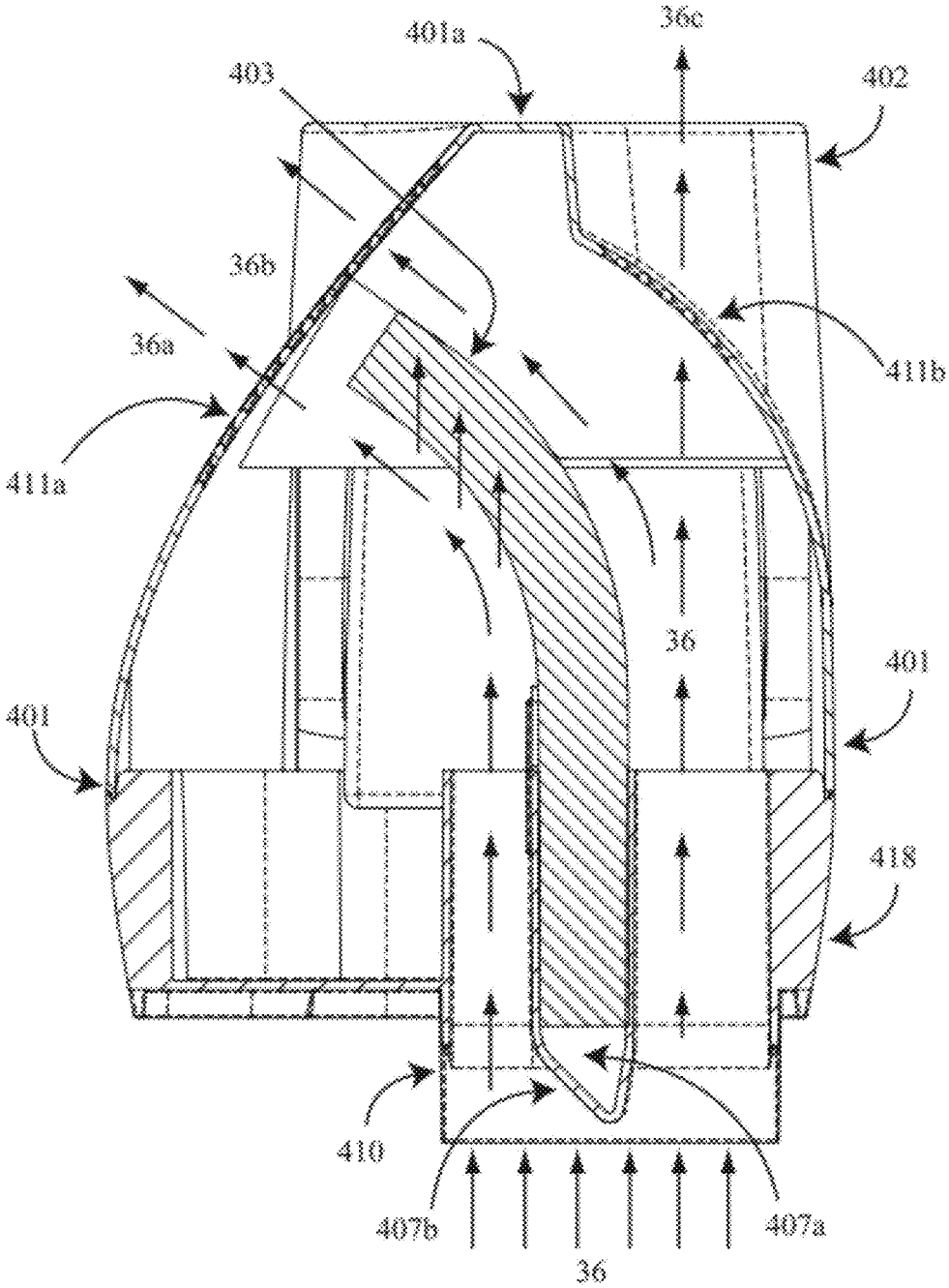
FIG. 20 is a sectional side view along the lines of B-B of FIG. 18, showing internal parts and air flow for the fifth embodiment.

FIG. 20 shows the side view sectioned along the lines of B-B of FIG. 18 with internal parts and air flow (36) of Embodiment 5. The angled hollow air corridor in the casing (401) and the curved evaporative filter element (403) ensure maxim hot air flow (36) with little obstruction on either sides of the evaporative filter element (403). A front air outlet grill (411*a*) is provided which is angled back from the lower front of the casing to a central area (401*a*) at the top of the casing, and a rear outlet grill (411*b*) is provided angled from the top of the casing (401*a*) down to a rear central portion; these grills accommodate firstly lower, inner outlet stream 36*a* and upper, outlet stream 36*b*; and secondly a rear, largely vertical outlet stream 36*c*. The base of the lower water pan (407*b*) has front and rear sides formed at an upwardly diverging acute angle to cause the incoming air flow (36) to diverge into two rectangular openings of the humidifier seating base (418) so as to minimize the any obstruction on the air flow (36) path. As seen in FIG. 19, flanges of air inlet base (410) sides are angled inward to direct air flow (36) to the humidifier corridor.

Spring operated valve (31) mechanism illustrated in FIG. 14 and the description in the previous section is still valid for the slightly modified valve (431) of Embodiment 5.

Operation:

Embodiment 5 of this room vent humidifier invention is very similar in its operation also has no electrical component, so it does not need to be plugged to any external power source. It uses the air flow of the heat source for its operation.

The Embodiment 5 of this invention as illustrated in FIGS. 15-20 operates as follows: The humidifier is assembled by clicking together all the parts illustrated in FIG. 16 and installed into the room air vent by removing the room air vent cover and fixing the room vent humidifier in its place. Main water tanks (402) are filled to the desired level with water (or other suitable liquid) through bottom water refill inlet and cap (417) is secured on the inlet to seal each water tank air tight. When the main water tank (402) is detached from casing (401) to fill with water, the spring operated valve (431) will keep the valve closed and there will not be any water flow from main water tank (402). When main water tanks (402) are properly fixed onto casing (401), projected post (432) of the lower water pan (407) will push up the valve member (41) of the spring and washer valve (431), opening the valve, and water will start passing to lower water reservoir (407). Water flow will stop when the water level reaches the same level as the bottom of the main water tank (402) because of the vacuum suction in the main water tank (402), thus keeping water level of the lower water reservoir (407) to a consistent level without overflowing it. Evaporative filter element (403) sitting in lower water pan (407*a*) will get moist through capillary action. The air flow (36) through the humidifier will contact the moist evaporative filter element (403) and will absorb the humidity.

When the air source blows the hot air through the vent, it is received by air inlet base (410) and directed evenly through the air corridor of the humidifier. The air corridor of the humidifier is angled in such a way that the hot air gets in contact with evaporative filter element (403) before exiting the humidifier. As more water is absorbed into evaporative filter element (403) and water level in lower reservoir (407) goes lower than the bottom of the main water tank the spring operated valve (431) will operate as described to maintain the water level in reservoir (407) and lower water pan (407*a*).

Details of Embodiment 6

A sixth embodiment of humidifier having a "water tank empty indicator" will now be described with reference to FIGS. 21 and 22 which show a humidifier similar to that shown in FIG. 15 but whose water tanks tilt when empty. Thus, each water tank (402) has its lower, outer edge resting on a seating 445 (see also FIG. 16) which serves as a fulcrum about which the water tank can pivot when its centre of gravity changes sufficiently, i.e., between at least partially full and effectively empty states.

Figure 21:
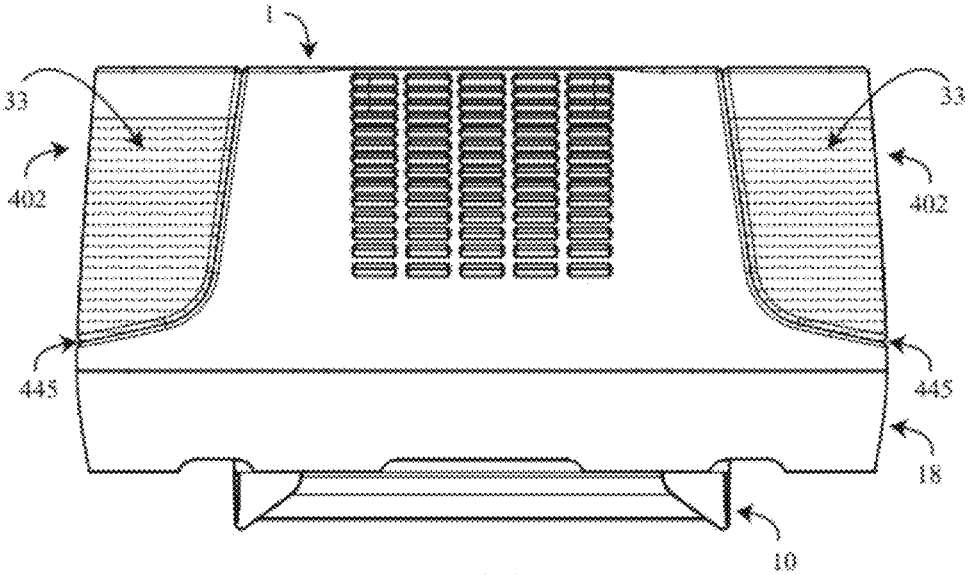
FIG. 21 is a front view of a sixth embodiment showing water tanks seated properly on the casing when water tanks have water in it.

FIG. 21 shows the front view of the humidifier with water (33) in each of the main water tanks (402). Each of the main water tanks (402) contains more than a minimal amount of water, so it fits snugly into the water tank seating base (30) and will remain seated on the water tank seating base (430) as long as it not completely empty.

Figure 22:
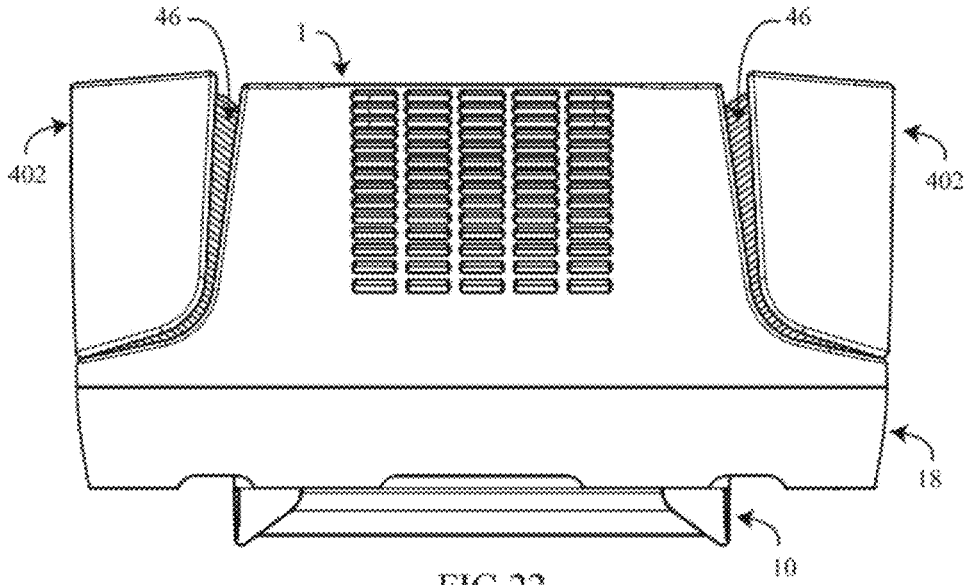
FIG. 22 is a front view of the sixth embodiment showing water tanks displaced from their seatings on the casing when the water tanks are empty.

FIG. 22 shows the front view of the humidifier of FIG. 21 when each of the main water tanks (402) is empty, or at least contains what is determined to be a minimal level of water. As shown in FIG. 22, when empty, each of the water tanks (402) tilts outwards on the pivotal plane (445) and displaces slightly from the water tank seating base (430). This "water tank empty" indication feature gives the user a built-in visual indication to re-fill the empty main water tanks (402). The portion 46 of the main water tank (402) which goes inside of the seating ridge of the casing (401) will be coloured differently so that when the empty main water tank (402) tilts outwards, the colour become visible and serves as the "water tank is empty" indication. The water tank empty indication (46) color will be visible to outside only when main water tanks (402) is fully empty and displaced from the water tank seating base (430).

It is envisaged that this manner of indicating that the water tank is empty could be employed with any of the other embodiments of the invention described above. Alternatively, it might be employed independently.

Room vent humidifiers embodying this invention may have many advantages over the room humidifiers presently known in the market; some are listed below.

A main advantage is highly effective room humidification by utilizing the natural air flow from the heat source so there is no need for electricity to operate it, making it very cost efficient and environment friendly.

The slide and click (detent) assembly mechanism of all the parts without any screws is also a main advantage of this invention.

Another advantage of embodiments of this invention is that they are highly effective room humidifiers which are effectively noise-free.

A further advantage of embodiments of this invention is that they provide a room humidifier which can be easily installed on wall and floor vents and can be used with any type of forced air heating systems and with some air conditioning systems. It does not require any complicated fixing mechanisms including screws and can be installed on vents easily without any tools. A slide and click detent assembly mechanism which allows assembly of all the parts without any screws is another main advantage of embodiments of this invention.

Yet another advantage of embodiments of this invention is that they provide a room humidifier wherein the heated air is directed at the evaporative filter element without interference from the water container of the humidifier. This design feature enables this device to be highly effective and efficient in its operation.

An advantage of embodiments having water tanks that tilt when empty is that user can see, at a glance, even from a significant distance, that the tank is empty and needs to be refilled.

Room humidifiers used with hot air registers, as referred to above, generally have only one water chamber. Embodiments of this invention having a secondary, lower water pan advantageously may avoid any water spills from the evaporative filter element and keep it moisturized substantially all the time if the water dripping from main water tank is not enough to keep the evaporative filter element moistened in the ON cycle of the heat source. This double water reservoir mechanism also provides humidifier embodying the invention with added the advantage of portability of the main water tank for re-fills.

Because of the room vent humidifier's design, an advantage of embodiments of the invention is that the evaporative filter element can be slid out without any tools and is easily replaceable and easily cleaned with minimal effort. Cleaning of the main water tank and lower water pan is also very easy for regular maintenance since all of these are detachable with a tab click or detent.

A further advantage of humidifiers embodying the present invention over other room humidifiers is that they can be equipped with a water inlet and float valve in the main water tank to automatically refill the tank whenever the water level in the water tank drops below a predetermined level set by the float valve; thus the humidifier will keep operating without human assistance.

This humidifier can be assembled and installed very quickly and easily without any technical or professional expertise which is an added advantage compared to other furnace mounted and vent mounted humidifiers.

The footprint space of this humidifier is little more than the size of the room vent which makes it extremely compact.

Another advantage is the built-in natural humidity control system by utilizing the ON/OFF cycle mechanism of the heat source. Also in embodiments having a grill shutter humidity can be shut off easily either by closing or controlling the grill shutter. Alternatively, in some embodiments, humidity can be controlled by shutting off the water supply by flipping the main water tank up-side down on the casing.

INDUSTRIAL APPLICABILITY

Humidifiers embodying this invention can be manufactured with much less cost than that of prior art humidifiers in this class, so they can be employed in multiple rooms of the same household. This is partly due to the fact that they do not require the use of any screws, nuts and bolts as a fixing mechanism for any of their parts or to install the humidifier to the vent. Humidifiers embodying this invention do not have any moving or rotating body parts, making them mechanically fool proof in operation.

Once given the above disclosure, many other improvements, modifications, and features will become apparent to the artisan skilled in the art. Such other improvements or modifications, and features are, therefore, considered to be within the scope of this invention as defined by the attached claims.

REFERENCE SIGNS LIST

1) Body Casing.
2) The Main water tank.
3) Evaporative filter element.
4) Evaporative filter element frame.
5) Evaporative filter element frame trough.
6) Evaporative filter element Sliding slot.
7) Lower water pan.
8) Water tank Pin holes.
9) Water tank click tab.
10) Air inlet base.
11) Air outlet grill.
12) Air outlet grill click tab.
13) Optional float valve.
14) Water level indicator tube.
15) Water level indicator.
16) Top water refill inlet and cap.
17) Bottom water refill inlet and cap.
18) Humidifier seating base.
19) Water Tank Float valve.
20) Ambient temperature controlled valve or air flow controlled valve.
21) Float valve assembly.
22) Air Float.
23) Valve fixing nut and bolt.
24) Water line.
25) Grill sliding shutter.
26) Casing hollow opening.
27) Bottom water inlet cap Groove.
28) Water tank tab.
29) Evaporative filter element trough holes.
30) Water tank seat base.
31) Spring operated valve.
32) Projected post.
33) Water/Liquid.
34) Room Flooring.
35) Room Air vent.
36) Air flow.
37) Room Wall.
38) Fixing Screws.
39) Valve Spring.
40) Valve stem.
41) Valve member.
42) Water hole.
43) Water tank partition.

The invention claimed is:

1. A room humidifier for use with a warm air register of the type used for supplying warm air to a room, said humidifier being readily portable and arranged to operate without an electrical supply, comprising:

a casing having an air inlet adapted to be positioned over an opening of the register for receiving air flow from said register, said casing having an air outlet for directing the air flow from the casing, an air porous evaporative filter element in said casing positioned in the path of air flow when moving from said inlet to said outlet, and the filter element having an upper edge and a lower edge portion, an upper reservoir in the form of a main water tank at least partly located above the filter element and having water outlet means allowing water to drip from the tank onto the upper edge of the filter element, and a lower reservoir in the casing in the form of a water pan surrounding the lower edge portion of said filter element and arranged both for receiving water which drips from said filter element and for supplying water to said filter element by capillary action.

2. A room humidifier according to claim 1, wherein said air porous evaporative filter element is a single substantially vertical element and is positioned transversely to the air flow direction when the air moves from the inlet to the outlet.

3. A room humidifier according to claim 1, wherein said main water tank is removable for re-filling, and wherein the filter element is mounted so as to be readily accessible and easily lifted from the casing for maintenance after removal of said main water tank.

4. A room humidifier according to claim 1 for use with a floor register, and wherein said casing includes deflecting means for redirecting vertically moving air from said floor register into a largely horizontal flow for movement through said filter element.

5. A humidifier according to claim 1 for use with a floor register opening, wherein the air inlet of the casing has a flange which is adapted to extend into the register opening.

6. A humidifier according to claim 3 wherein said main water tank and the casing are provided with engaging means including a slide and detent mechanism.

7. A humidifier according to claim 1 wherein said main water tank has a water refill opening at the top for filling said main water tank with water without removing it from said casing, and wherein said humidifier further comprises a cap to close said opening to make the main water tank airtight.

8. A humidifier according to claim 3 wherein said main water tank has a water refill opening at the bottom for filling said main water tank with water by detaching it from said casing, and wherein said humidifier further comprises a cap to close said opening to make the main water tank airtight.

9. A humidifier according to claim 1 wherein said water outlet means are pin holes at the bottom of the main water tank.

10. A humidifier according to claim 1 wherein the main water tank has a water level indicator made of a transparent material with a readily visible float.

11. A humidifier according to claim 2 wherein a sheet metal mesh is attached on the external side of the evaporative filter element for rigidity.

12. A humidifier according to claim 2 wherein said evaporative filter element is fixed inside a plastic frame for rigidity.

13. A humidifier according to claim 3 wherein said casing has two spaced opposed channels on opposite sides thereof to support said evaporative filter element and frame, and wherein said evaporative filter element can slide vertically into or out of the space between said channels when said main water tank has been removed.

14. A humidifier according to claim 12 wherein said frame of the evaporative filter element further comprises a distribution trough on the upper edge thereof to collect and distribute the water emitted from the main water tank evenly to the evaporative filter element.

15. A humidifier according to claim 14 wherein said distribution trough has multiple holes there in, said holes spaced along the length of said distribution trough.

16. A humidifier according to claim 1, wherein said lower reservoir water pan is made of plastic and arranged both to collect water from main water tank and to collect any excess water spilled by the evaporative filter element and to keep it moisturized continuously through capillary action.

17. A humidifier according to claim 1 wherein a protective grill is installed at the air outlet of the casing with a snap on mechanism to protect the evaporative filter element from any external damages.

18. A humidifier according to claim 17 wherein a slide shutter is provided on the inside of the grill to control the airflow.

19. A humidifier according to claim 1, further comprising a float valve assembly on the said main water tank, said float valve assembly being adapted to be connected to a continuous water supply line, said float valve assembly being adapted to regulate the intake of water into the main water tank.

20. A humidifier according to claim 1 further comprising a spring operated valve attached at the bottom of said main water tank to control the water flow to said lower reservoir water pan, wherein said spring operated valve will operate and open only when said main water tank is placed in the casing.

21. A humidifier according to claim 20 further comprising an ambient temperature controlled valve at said water outlet means to regulate flow of water to the evaporative filter element, said valve being arranged only to open when the hot air flows from said register.

22. A humidifier according to claim 1 further comprising an air flow controlled valve at the said water outlet means to regulate flow of water to the evaporative filter element, said valve being arranged only to open when the air flows through said register.

23. A room humidifier for use with a warm air register of the type used for supplying warm air to a room, said humidifier being readily portable and arranged to operate without an electrical supply, and comprising:

a casing having an inlet adapted to be positioned for receiving air from said register, said casing having two opposed outlets for directing the air at least partially horizontally from the casing in opposite directions, two air porous evaporative filter elements in said casing, each positioned upright in the path of air when moving from said inlet to one of said outlets, an upper reservoir in the form of a main water tank at least partly located above both filter elements and having water outlet means allowing water to drip from the tank onto an upper edge of each said filter element, and two lower reservoirs in the casing, each in the form of a water pan surrounding a lower edge portion of one of said filter elements and arranged both for receiving water which drips from said filter elements and for supplying water to said filter elements by capillary action.

24. A room humidifier for use with a warm air floor register of the type used for supplying warm air to a room, said humidifier being readily portable and arranged to operate without an electrical supply, comprising:

a casing having a base with an inlet adapted to be positioned over an opening of a floor register, for receiving air flow from said floor register, said casing having an outlet for directing the air flow from the casing, an air porous evaporative filter element in said casing positioned to contact air flow when moving from said inlet to said outlet, a lower water pan which receives a lower edge portion of the filter element;

a lower reservoir in the casing surrounding and communicating with said lower water pan;

a removable main water tank having a spring operated valve regulating flow of water from said tank into the lower reservoir to maintain a predetermined level of water in the reservoir and in the lower water pan.

25. A humidifier according to claim 24, including a flange projecting downwards from the base and adapted to fit into the opening of the floor register, to locate the humidifier relative to the register.

26. A humidifier according to claim 24, wherein the lower water pan which receives the lower edge portion of the filter element has sides which diverge from an acute angled lower corner of the water pan, such that said lower corner divides the airflow into said inner and outer air flows.

27. A humidifier according to claim 24, wherein the casing comprises:

a hollow upper casing providing said outlet, and having a recess for receiving said removable water tank, and a lower casing providing said base, said inlet, and said lower water pan, and means co-operating with said water tank so that when said tank is in place in said recess water can flow into said lower reservoir, and wherein both said upper and lower casings are molded of plastics material and have interlocking means which can hold the casings together without screws or like fasteners.

28. A humidifier according to claim 24, wherein said lower casing can receive two said water tanks, one on each side of the casing.

29. A humidifier according to claim 24, wherein said main water tank is made of transparent plastic material to enable observation of the water level from outside.

30. A humidifier according to claim 24, wherein said main water tank has a water refill opening at the bottom for filling said main water tank with water by detaching it from said casing, and wherein said humidifier further comprises a cap to close said opening to make the main water tank airtight.

31. A humidifier according to claim 30, wherein said cap incorporates a spring operated valve mechanism to prevent water leak in portability of said water tank, and wherein said lower reservoir has a projected post to push open the spring operated valve mechanism to spill water to said lower reservoir, whereby wherein said spring operated valve will open only when the said water tank is placed in the casing.

32. A humidifier according to claim 24, wherein said casing has air outlet grills allowing air to flow from said humidifier both upwards and outwards at the front, and substantially vertically from the top.

33. A humidifier according to claim 24, wherein said main water tank has a concave aperture to serve as a handle to lift it and carry for refills.

34. A humidifier according to claim 24, wherein said main water tank has step seating edges to fit snugly to the casing.

35. A humidifier according to claim 24, wherein said outlet directs the air at least partially horizontally from the casing.

36. A humidifier according to claim 24, wherein the water tank is mounted and balanced for pivoting about a fulcrum between a first position when containing water and a second position when substantially emptied of water.

37. A room humidifier for use with a warm air floor register of the type used for supplying warm air to a room, said humidifier being readily portable and arranged to operate without an electrical supply, comprising:

a casing having a base with an inlet adapted to be positioned for receiving air flow from said register, said casing having an outlet for directing the air flow from the casing, an air porous evaporative filter element in said casing positioned to contact air flow when moving from said inlet to said outlet, a lower water pan which receives a lower edge portion of the filter element;

a lower reservoir in the casing surrounding and communicating with said lower water pan;

a removable main water tank having a spring operated valve regulating flow of water from said tank into the lower reservoir to maintain a predetermined level of water in the reservoir and in the lower water pan, wherein said filter element includes a lower portion which is substantially vertical and which includes said lower edge portion, and an upper portion which is curved towards the outlet such as to be capable of deflecting air coming from the register and flowing in contact with the lower portion, towards said outlet.

38. A humidifier according to claim 37, wherein said lower water pan which receives the lower edge portion of the filter element is positioned so as to divide a flow of air coming from the register into an inner, lower air flow which is deflected by an inner concave surface of said curved upper filter element portion, and an outer upper air flow which contacts the outer convex surface of the upper filter element portion.

39. A room humidifier for use with a warm air floor register of the type used for supplying warm air to a room, said humidifier being readily portable and arranged to operate without an electrical supply, comprising:

a casing having a base with an inlet adapted to be positioned for receiving air flow from said floor register, said casing having an outlet for directing the air flow from the casing, an air porous evaporative filter element in said casing positioned to contact air flow from said inlet to said outlet, a lower water pan which receives a lower edge portion of the filter element;

a lower reservoir in the casing surrounding and communicating with said lower water pan;

a removable main water tank having a spring operated valve regulating flow of water from said tank into the lower reservoir to maintain a predetermined level of water in the reservoir and in the lower water pan; and wherein said water tank is balanced so as to displace automatically between a first position when containing a prescribed level of water and a second position when substantially emptied of water.

40. A humidifier according to claim 39, wherein the reservoir has a contrasting portion exposed when the reservoir is in one of said the first and second positions but not the other of the first and second positions.

* * * * *